US007698101B2

(12) United States Patent
Alten et al.

(10) Patent No.: US 7,698,101 B2
(45) Date of Patent: Apr. 13, 2010

(54) SMART GARMENT

(75) Inventors: Brett G. Alten, Cupertino, CA (US); Robert Edward Borchers, Pleasanton, CA (US)

(73) Assignee: Apple Inc., Cupertino, CA (US)

( * ) Notice: Subject to any disclaimer, the term of this patent is extended or adjusted under 35 U.S.C. 154(b) by 330 days.

(21) Appl. No.: 11/683,391

(22) Filed: Mar. 7, 2007

(65) Prior Publication Data

US 2008/0218310 A1 Sep. 11, 2008

(51) Int. Cl.
*G08B 29/00* (2006.01)

(52) U.S. Cl. ..... 702/182; 340/5.8

(58) Field of Classification Search ..... None
See application file for complete search history.

(56) References Cited

U.S. PATENT DOCUMENTS

| | | | |
|---|---|---|---|
| 3,612,265 | A | 10/1971 | Dickerson |
| 3,807,388 | A | 4/1974 | Orr et al. |
| 3,918,058 | A | 11/1975 | Noyori et al. |
| 3,958,459 | A | 5/1976 | Shimomura |
| 3,978,725 | A | 9/1976 | Hadtke |
| 4,089,057 | A | 5/1978 | Eriksson |
| 4,090,216 | A | 5/1978 | Constable |
| 4,101,873 | A | 7/1978 | Anderson et al. |
| 4,114,450 | A | 9/1978 | Shulman et al. |
| 4,195,642 | A | 4/1980 | Price et al. |
| 4,210,024 | A | 7/1980 | Ishiwatari et al. |
| 4,223,211 | A | 9/1980 | Allsen et al. |
| 4,248,244 | A | 2/1981 | Charnitski et al. |
| 4,317,126 | A | 2/1982 | Gragg, Jr. |
| 4,371,188 | A | 2/1983 | Hull |
| 4,371,945 | A | 2/1983 | Karr et al. |
| 4,375,674 | A | 3/1983 | Thornton |
| 4,386,345 | A | 5/1983 | Narveson et al. |
| 4,423,630 | A | 1/1984 | Morrison |
| 4,434,801 | A | 3/1984 | Jiminez et al. |
| 4,451,849 | A | 5/1984 | Fuhrer |
| 4,516,110 | A | 5/1985 | Overmyer |
| 4,516,865 | A | 5/1985 | Hideo |
| 4,578,769 | A | 3/1986 | Frederick |
| 4,589,022 | A | 5/1986 | Prince et al. |
| 4,625,733 | A | 12/1986 | Saynajakangas |

(Continued)

FOREIGN PATENT DOCUMENTS

| | | | |
|---|---|---|---|
| DE | 43 34 773 | A1 | 4/1994 |

(Continued)

OTHER PUBLICATIONS

"Apple Announces iTunes 2," Press Release, Apple Computer, Inc., Oct. 23, 2001.

(Continued)

*Primary Examiner*—Manuel L Barbee
(74) *Attorney, Agent, or Firm*—Beyer Law Group LLP

(57) ABSTRACT

A sensor authenticated to a garment transfers information, either wirelessly or wired, to an external data processing device. Such information includes location information, physiometric data of the individual wearing the garment, garment performance and wear data (when the garment is an athletic shoe, for example). The external data processing device can be portable digital media players that are, in turn, in wireless communication with a server computer or other wireless devices.

43 Claims, 12 Drawing Sheets

U.S. PATENT DOCUMENTS

| | | | | |
|---|---|---|---|---|
| 4,694,694 | A | | 9/1987 | Vlakancic et al. |
| 4,699,379 | A | | 10/1987 | Chateau et al. |
| 4,703,445 | A | * | 10/1987 | Dassler ..... 702/160 |
| 4,720,093 | A | | 1/1988 | Del Mar |
| 4,722,222 | A | | 2/1988 | Purdy et al. |
| 4,736,312 | A | | 4/1988 | Dassler et al. |
| 4,745,564 | A | | 5/1988 | Tennes et al. |
| 4,757,453 | A | | 7/1988 | Nasiff |
| 4,757,714 | A | | 7/1988 | Purdy et al. |
| 4,759,219 | A | | 7/1988 | Cobb et al. |
| 4,763,275 | A | | 8/1988 | Carlin |
| 4,763,284 | A | | 8/1988 | Carlin |
| 4,763,287 | A | | 8/1988 | Gerhaeuser et al. |
| 4,771,394 | A | | 9/1988 | Cavanagh |
| 4,774,679 | A | | 9/1988 | Carlin |
| 4,775,948 | A | | 10/1988 | Dial et al. |
| 4,780,837 | A | | 10/1988 | Namekawa |
| 4,821,218 | A | | 4/1989 | Potsch |
| 4,822,042 | A | | 4/1989 | Landsman |
| 4,824,107 | A | | 4/1989 | French |
| 4,829,812 | A | | 5/1989 | Parks et al. |
| 4,830,021 | A | | 5/1989 | Thornton |
| 4,862,394 | A | | 8/1989 | Thompson et al. |
| 4,862,395 | A | | 8/1989 | Fey et al. |
| 4,873,867 | A | | 10/1989 | McPherson et al. |
| 4,876,500 | A | | 10/1989 | Wu |
| 4,883,271 | A | | 11/1989 | French |
| 4,903,212 | A | | 2/1990 | Yokouchi et al. |
| 4,908,523 | A | | 3/1990 | Snowden et al. |
| 4,928,307 | A | | 5/1990 | Lynn |
| 4,935,887 | A | | 6/1990 | Abdalah et al. |
| 4,951,171 | A | | 8/1990 | Tran et al. |
| 4,955,980 | A | | 9/1990 | Masuo |
| 5,033,013 | A | | 7/1991 | Kato et al. |
| 5,036,467 | A | | 7/1991 | Blackburn et al. |
| 5,056,783 | A | | 10/1991 | Matcovich et al. |
| 5,067,081 | A | | 11/1991 | Person |
| 5,088,836 | A | | 2/1992 | Yamada et al. |
| 5,117,444 | A | | 5/1992 | Sutton et al. |
| 5,144,226 | A | | 9/1992 | Rapp |
| 5,148,002 | A | | 9/1992 | Kuo et al. |
| 5,150,310 | A | | 9/1992 | Greenspun et al. |
| 5,162,828 | A | | 11/1992 | Furness et al. |
| 5,181,181 | A | | 1/1993 | Glynn |
| 5,200,827 | A | | 4/1993 | Hanson et al. |
| 5,243,993 | A | | 9/1993 | Alexander et al. |
| 5,258,927 | A | | 11/1993 | Havriluk et al. |
| 5,295,085 | A | | 3/1994 | Hoffacker |
| 5,316,249 | A | | 5/1994 | Anderson |
| 5,324,038 | A | | 6/1994 | Sasser |
| 5,335,664 | A | | 8/1994 | Nagashima |
| 5,339,699 | A | | 8/1994 | Carignan |
| 5,343,445 | A | | 8/1994 | Cherdak |
| 5,348,519 | A | | 9/1994 | Prince et al. |
| 5,382,972 | A | | 1/1995 | Kannes |
| 5,396,429 | A | | 3/1995 | Hanchett |
| 5,406,305 | A | | 4/1995 | Shimomura et al. |
| 5,420,828 | A | | 5/1995 | Geiger |
| 5,426,595 | A | | 6/1995 | Picard |
| 5,436,838 | A | | 7/1995 | Miyamori |
| 5,446,775 | A | | 8/1995 | Wright et al. |
| 5,450,329 | A | | 9/1995 | Tanner |
| 5,452,269 | A | | 9/1995 | Cherdak |
| 5,471,405 | A | | 11/1995 | Marsh |
| 5,475,725 | A | | 12/1995 | Nakamura |
| 5,476,427 | A | | 12/1995 | Fujima |
| 5,478,006 | A | | 12/1995 | Taguchi |
| 5,485,402 | A | | 1/1996 | Smith et al. |
| 5,486,815 | A | | 1/1996 | Wagner |
| 5,509,082 | A | | 4/1996 | Toyama et al. |
| 5,513,854 | A | | 5/1996 | Daver |
| 5,524,637 | A | | 6/1996 | Erickson |
| 5,526,326 | A | | 6/1996 | Fekete et al. |
| 5,528,228 | A | | 6/1996 | Wilk |
| 5,539,336 | A | | 7/1996 | Nguyen et al. |
| 5,541,604 | A | | 7/1996 | Meier |
| 5,546,307 | A | | 8/1996 | Mazur et al. |
| 5,546,974 | A | | 8/1996 | Bireley |
| 5,559,945 | A | | 9/1996 | Beaudet et al. |
| 5,564,698 | A | | 10/1996 | Honey et al. |
| 5,574,669 | A | | 11/1996 | Marshall |
| 5,583,776 | A | | 12/1996 | Levi et al. |
| 5,583,993 | A | | 12/1996 | Foster et al. |
| 5,590,908 | A | | 1/1997 | Carr |
| 5,592,401 | A | | 1/1997 | Kramer |
| 5,605,336 | A | | 2/1997 | Gaoiran et al. |
| 5,608,698 | A | | 3/1997 | Yamanoi et al. |
| 5,615,132 | A | | 3/1997 | Horton et al. |
| 5,616,876 | A | | 4/1997 | Cluts |
| 5,617,084 | A | | 4/1997 | Sears |
| 5,617,386 | A | | 4/1997 | Choi |
| 5,618,995 | A | | 4/1997 | Otto et al. |
| 5,627,548 | A | | 5/1997 | Woo et al. |
| 5,629,131 | A | | 5/1997 | De Keyzer et al. |
| 5,633,070 | A | | 5/1997 | Murayama et al. |
| 5,636,146 | A | | 6/1997 | Flentov et al. |
| 5,646,857 | A | | 7/1997 | McBurney et al. |
| 5,670,985 | A | | 9/1997 | Cappels, Sr. et al. |
| 5,671,010 | A | | 9/1997 | Shimbo et al. |
| 5,671,162 | A | | 9/1997 | Werbin |
| 5,673,691 | A | | 10/1997 | Abrams et al. |
| 5,680,102 | A | | 10/1997 | Xydis |
| 5,684,513 | A | | 11/1997 | Decker |
| 5,688,183 | A | | 11/1997 | Sabatino et al. |
| 5,690,119 | A | | 11/1997 | Rytky et al. |
| 5,690,591 | A | | 11/1997 | Kenmochi et al. |
| 5,690,773 | A | | 11/1997 | Fidalgo et al. |
| 5,694,340 | A | | 12/1997 | Kim |
| 5,701,257 | A | | 12/1997 | Miura et al. |
| 5,710,922 | A | | 1/1998 | Alley et al. |
| 5,712,638 | A | | 1/1998 | Issa |
| 5,712,949 | A | | 1/1998 | Kato et al. |
| 5,720,200 | A | | 2/1998 | Anderson et al. |
| 5,721,539 | A | | 2/1998 | Goetzl |
| 5,721,949 | A | | 2/1998 | Smith et al. |
| 5,723,786 | A | | 3/1998 | Klapman |
| 5,724,265 | A | | 3/1998 | Hutchings |
| 5,726,672 | A | | 3/1998 | Hernandez et al. |
| 5,734,337 | A | | 3/1998 | Kupersmit |
| 5,738,104 | A | | 4/1998 | Lo et al. |
| 5,739,451 | A | | 4/1998 | Winksy et al. |
| 5,740,143 | A | | 4/1998 | Suetomi |
| 5,743,269 | A | | 4/1998 | Okigami et al. |
| 5,745,037 | A | | 4/1998 | Guthrie et al. |
| 5,749,615 | A | | 5/1998 | Itson |
| 5,761,096 | A | | 6/1998 | Zakutin |
| 5,771,485 | A | | 6/1998 | Echigo |
| 5,779,576 | A | | 7/1998 | Smith, III et al. |
| 5,781,155 | A | | 7/1998 | Woo et al. |
| 5,790,477 | A | | 8/1998 | Hauke |
| 5,807,284 | A | | 9/1998 | Foxlin |
| 5,812,056 | A | | 9/1998 | Law |
| 5,815,225 | A | | 9/1998 | Nelson |
| 5,822,288 | A | | 10/1998 | Shinada |
| 5,835,721 | A | | 11/1998 | Donahue et al. |
| 5,835,732 | A | | 11/1998 | Kikinis et al. |
| 5,862,803 | A | | 1/1999 | Besson et al. |
| 5,864,868 | A | | 1/1999 | Contois |
| 5,870,710 | A | | 2/1999 | Ozawa et al. |
| 5,886,739 | A | | 3/1999 | Winningstad |
| 5,891,042 | A | | 4/1999 | Sham et al. |
| 5,895,073 | A | * | 4/1999 | Moore ..... 283/70 |
| 5,897,457 | A | | 4/1999 | Mackovjak |
| 5,899,963 | A | | 5/1999 | Hutchings |

5,901,303 A 5/1999 Chew
5,905,460 A 5/1999 Odagiri et al.
5,918,281 A 6/1999 Nabulsi
5,918,303 A 6/1999 Yamaura et al.
5,920,728 A 7/1999 Hallowell et al.
5,923,757 A 7/1999 Hocker et al.
5,925,001 A 7/1999 Hoyt et al.
5,929,335 A 7/1999 Carter
5,930,741 A 7/1999 Kramer
5,936,523 A 8/1999 West
5,946,643 A 8/1999 Zakutin
5,947,917 A 9/1999 Carte et al.
5,952,992 A 9/1999 Helms
5,955,667 A 9/1999 Fyfe
5,959,568 A 9/1999 Woolley
5,960,380 A 9/1999 Flentov et al.
5,963,523 A 10/1999 Kayama et al.
5,963,891 A 10/1999 Walker et al.
5,976,083 A 11/1999 Richardson et al.
5,977,877 A 11/1999 McCulloch et al.
5,978,972 A 11/1999 Stewart et al.
5,984,842 A 11/1999 Chu
6,002,982 A 12/1999 Fry
6,006,274 A 12/1999 Hawkins et al.
6,009,237 A 12/1999 Hirabayashi et al.
6,009,629 A 1/2000 Gnepf et al.
6,011,491 A 1/2000 Goetzl
6,011,585 A 1/2000 Anderson
6,013,007 A 1/2000 Root et al.
6,018,677 A 1/2000 Vidrine et al.
6,018,705 A 1/2000 Gaudet et al.
6,020,851 A 2/2000 Busack
6,028,617 A 2/2000 Sawano et al.
6,028,625 A 2/2000 Cannon
6,028,627 A 2/2000 Helmsderfer
6,032,084 A 2/2000 Anderson et al.
6,032,108 A 2/2000 Seiple et al.
6,032,530 A 3/2000 Hock
6,041,023 A 3/2000 Lakhansingh
6,043,747 A 3/2000 Altenhofen
6,045,364 A 4/2000 Dugan et al.
6,052,654 A 4/2000 Gaudet et al.
6,057,756 A 5/2000 Engellenner
6,059,576 A 5/2000 Brann
6,073,086 A 6/2000 Marinelli
6,074,271 A 6/2000 Derrah
6,075,443 A 6/2000 Schepps et al.
6,091,342 A 7/2000 Janesch et al.
6,108,426 A 8/2000 Stortz
6,111,541 A 8/2000 Karmel
6,111,571 A 8/2000 Summers
6,122,340 A 9/2000 Darley et al.
6,122,959 A 9/2000 Hoshal et al.
6,122,960 A 9/2000 Hutchings et al.
6,125,686 A 10/2000 Haan et al.
6,127,931 A 10/2000 Mohr
6,145,389 A 11/2000 Ebeling et al.
6,148,271 A 11/2000 Marinelli
6,151,647 A 11/2000 Sarat
6,157,898 A 12/2000 Marinelli
6,160,254 A 12/2000 Zimmerman et al.
6,161,944 A 12/2000 Leman
6,163,021 A 12/2000 Mickelson
6,167,356 A 12/2000 Squadron et al.
6,172,948 B1 1/2001 Keller et al.
6,179,432 B1 1/2001 Zhang et al.
6,183,425 B1 2/2001 Whalen et al.
6,191,939 B1 2/2001 Burnett
6,196,932 B1 3/2001 Marsh et al.
6,204,813 B1 3/2001 Wadell et al.
6,208,044 B1 3/2001 Viswanadham et al.
6,216,131 B1 4/2001 Liu et al.
6,217,183 B1 4/2001 Shipman
6,226,622 B1 5/2001 Dabbiere
6,238,338 B1 5/2001 DeLuca et al.
6,245,002 B1 6/2001 Beliakov
6,248,946 B1 6/2001 Dwek
6,249,487 B1 6/2001 Yano et al.
6,254,513 B1 7/2001 Takenaka et al.
6,263,279 B1 7/2001 Bianco et al.
6,266,623 B1 7/2001 Vock et al.
6,295,541 B1 9/2001 Bodnar et al.
6,298,314 B1 10/2001 Blackadar et al.
6,305,221 B1 10/2001 Hutchings
6,332,175 B1 12/2001 Birrell et al.
6,336,365 B1 1/2002 Blackadar et al.
6,336,727 B1 1/2002 Kim
6,341,316 B1 1/2002 Kloba et al.
6,356,856 B1 3/2002 Damen et al.
6,357,147 B1 3/2002 Darley et al.
6,360,597 B1 3/2002 Hubbard, Jr.
6,377,530 B1 4/2002 Burrows
6,380,597 B1 4/2002 Gudesen et al.
6,385,473 B1 5/2002 Haines et al.
6,436,052 B1 8/2002 Nikolic et al.
6,441,747 B1 8/2002 Khair et al.
6,452,610 B1 9/2002 Reinhardt et al.
6,456,261 B1 9/2002 Zhang
6,459,881 B1 10/2002 Hoder et al.
6,467,924 B2 10/2002 Shipman
6,493,652 B1 12/2002 Ohlenbusch et al.
6,498,994 B2 12/2002 Vock et al.
6,501,393 B1 12/2002 Richards et al.
6,504,483 B1 1/2003 Richards et al.
6,516,284 B2 2/2003 Flentov et al.
6,527,711 B1 3/2003 Stivoric et al.
6,529,131 B2 3/2003 Wentworth
6,531,982 B1 3/2003 White et al.
6,536,139 B2 3/2003 Darley et al.
6,539,336 B1 3/2003 Vock et al.
6,549,497 B2 4/2003 Miyamoto et al.
6,560,903 B1 5/2003 Darley
6,563,417 B1 5/2003 Shaw
6,570,526 B1 5/2003 Noller et al.
6,587,403 B1 7/2003 Keller et al.
6,587,404 B1 7/2003 Keller et al.
6,595,929 B2 7/2003 Stivoric et al.
6,600,418 B2 7/2003 Sainati et al.
6,605,038 B1 8/2003 Teller et al.
6,611,782 B1 8/2003 Wooster et al.
6,611,789 B1 * 8/2003 Darley ..... 702/160
6,617,962 B1 9/2003 Horwitz et al.
6,619,835 B2 9/2003 Kita
6,621,768 B1 9/2003 Keller et al.
6,623,427 B2 9/2003 Mandigo
6,633,743 B1 10/2003 Berlinsky
6,643,608 B1 11/2003 Hershey et al.
6,714,121 B1 3/2004 Moore
6,731,312 B2 5/2004 Robbin
6,735,630 B1 5/2004 Gelvin et al.
6,748,902 B1 6/2004 Boesch et al.
6,760,536 B1 7/2004 Amir et al.
6,762,741 B2 7/2004 Weindorf
6,772,331 B1 8/2004 Hind et al.
6,794,566 B2 9/2004 Pachet
6,799,226 B1 9/2004 Robbin et al.
6,801,964 B1 10/2004 Mahdavi
6,813,586 B1 11/2004 Vock et al.
6,825,777 B2 11/2004 Vock et al.
6,837,827 B1 1/2005 Lee et al.
6,856,934 B2 2/2005 Vock et al.
6,870,529 B1 3/2005 Davis
6,871,063 B1 3/2005 Schiffer
6,876,947 B1 4/2005 Darley et al.
6,882,955 B1 4/2005 Ohlenbusch et al.
6,883,694 B2 4/2005 Abelow

| | | | |
|---|---|---|---|
| 6,885,971 | B2 | 4/2005 | Vock et al. |
| 6,898,550 | B1 | 5/2005 | Blackadar et al. |
| 6,900,732 | B2 | 5/2005 | Richards |
| 6,911,971 | B2 | 6/2005 | Suzuki et al. |
| 6,914,551 | B2 | 7/2005 | Vidal |
| 6,918,677 | B2 | 7/2005 | Shipman |
| 6,934,812 | B1 | 8/2005 | Robbin et al. |
| 6,950,087 | B2 | 9/2005 | Knox et al. |
| 6,959,259 | B2 | 10/2005 | Vock et al. |
| 7,009,517 | B2 | 3/2006 | Wood |
| 7,042,360 | B2 | 5/2006 | Light et al. |
| 7,046,230 | B2 | 5/2006 | Zadesky |
| 7,054,784 | B2 | 5/2006 | Flentov et al. |
| 7,062,225 | B2 | 6/2006 | White |
| 7,064,669 | B2 | 6/2006 | Light et al. |
| 7,072,789 | B2 | 7/2006 | Vock et al. |
| 7,084,856 | B2 | 8/2006 | Huppi |
| 7,084,921 | B1 | 8/2006 | Ogawa |
| 7,092,846 | B2 | 8/2006 | Vock et al. |
| 7,146,437 | B2 | 12/2006 | Robbin et al. |
| 7,174,130 | B2 | 2/2007 | Kurisko et al. |
| 7,174,277 | B2 | 2/2007 | Vock et al. |
| 7,234,026 | B2 | 6/2007 | Robbin et al. |
| 7,254,516 | B2 | 8/2007 | Case et al. |
| 2001/0022828 | A1 | 9/2001 | Pyles |
| 2001/0033244 | A1 | 10/2001 | Harris et al. |
| 2001/0041021 | A1 | 11/2001 | Boyle et al. |
| 2001/0042107 | A1 | 11/2001 | Palm |
| 2001/0049890 | A1* | 12/2001 | Hirsch et al. ..... 36/132 |
| 2002/0002413 | A1 | 1/2002 | Tokue |
| 2002/0013784 | A1 | 1/2002 | Swanson |
| 2002/0022551 | A1 | 2/2002 | Watterson et al. |
| 2002/0045961 | A1 | 4/2002 | Gibbs et al. |
| 2002/0046315 | A1 | 4/2002 | Miller et al. |
| 2002/0055934 | A1 | 5/2002 | Lipscomb et al. |
| 2002/0090912 | A1 | 7/2002 | Cannon et al. |
| 2002/0116082 | A1 | 8/2002 | Gudorf |
| 2002/0152045 | A1 | 10/2002 | Dowling et al. |
| 2002/0161865 | A1 | 10/2002 | Nguyen |
| 2002/0173273 | A1 | 11/2002 | Spurgat et al. |
| 2002/0189426 | A1 | 12/2002 | Hirade et al. |
| 2003/0016844 | A1* | 1/2003 | Numaoka ..... 382/100 |
| 2003/0037254 | A1 | 2/2003 | Fischer et al. |
| 2003/0046434 | A1 | 3/2003 | Flanagin et al. |
| 2003/0065805 | A1 | 4/2003 | Barnes, Jr. |
| 2003/0074457 | A1 | 4/2003 | Kluth |
| 2003/0076301 | A1 | 4/2003 | Tsuk et al. |
| 2003/0079038 | A1 | 4/2003 | Robbin et al. |
| 2003/0095096 | A1 | 5/2003 | Robbin et al. |
| 2003/0097379 | A1 | 5/2003 | Ireton |
| 2003/0133694 | A1 | 7/2003 | Yeo |
| 2003/0163287 | A1 | 8/2003 | Vock et al. |
| 2003/0167318 | A1 | 9/2003 | Robbin et al. |
| 2003/0229490 | A1 | 12/2003 | Etter |
| 2004/0001395 | A1 | 1/2004 | Keller et al. |
| 2004/0001396 | A1 | 1/2004 | Keller et al. |
| 2004/0012556 | A1 | 1/2004 | Yong et al. |
| 2004/0055446 | A1 | 3/2004 | Robbin et al. |
| 2004/0069122 | A1 | 4/2004 | Wilson |
| 2004/0076086 | A1 | 4/2004 | Keller et al. |
| 2004/0086120 | A1 | 5/2004 | Akins, III et al. |
| 2004/0094018 | A1 | 5/2004 | Ueshima et al. |
| 2004/0104845 | A1 | 6/2004 | McCarthy |
| 2004/0198436 | A1 | 10/2004 | Alden |
| 2004/0224638 | A1 | 11/2004 | Fadell et al. |
| 2004/0267825 | A1 | 12/2004 | Novak et al. |
| 2005/0015254 | A1 | 1/2005 | Beaman |
| 2005/0027910 | A1 | 2/2005 | Barrett, Jr. et al. |
| 2005/0080566 | A1 | 4/2005 | Vock et al. |
| 2005/0088275 | A1 | 4/2005 | Valoteau et al. |
| 2005/0166153 | A1 | 7/2005 | Eytchison et al. |
| 2005/5152294 | | 7/2005 | Yu et al. |
| 2005/0177929 | A1 | 8/2005 | Greenwald et al. |
| 2005/0245839 | A1 | 11/2005 | Stivoric et al. |
| 2005/0266798 | A1 | 12/2005 | Moloney et al. |
| 2005/0266961 | A1 | 12/2005 | Shum et al. |
| 2006/0013414 | A1 | 1/2006 | Shih |
| 2006/0068760 | A1 | 3/2006 | Hameed et al. |
| 2006/0097847 | A1 | 5/2006 | Bervoets et al. |
| 2006/0152377 | A1 | 7/2006 | Beebe et al. |
| 2006/0190577 | A1 | 8/2006 | Yamada |
| 2006/0221788 | A1 | 10/2006 | Lindahl et al. |
| 2006/0265503 | A1 | 11/2006 | Jones et al. |
| 2007/0011919 | A1* | 1/2007 | Case ..... 36/132 |
| 2007/0021269 | A1 | 1/2007 | Shum |
| 2007/0028009 | A1 | 2/2007 | Robbin et al. |
| 2007/0032195 | A1 | 2/2007 | Kurisko et al. |
| 2007/0124679 | A1 | 5/2007 | Jeong et al. |
| 2008/0125288 | A1* | 5/2008 | Case ..... 482/1 |

FOREIGN PATENT DOCUMENTS

| | | | |
|---|---|---|---|
| DE | 44 45 023 | A1 | 6/1996 |
| DE | 10325805 | | 1/2005 |
| EP | 0 127 139 | | 5/1984 |
| EP | 0336782 | A2 | 10/1989 |
| EP | 0578604 | | 1/1994 |
| EP | 0 757 437 | | 2/1997 |
| EP | 0 863 469 | | 9/1998 |
| EP | 0 917 077 | | 5/1999 |
| EP | 0917893 | B1 | 5/1999 |
| EP | 0 982 732 | | 3/2000 |
| EP | 1 028 425 | | 8/2000 |
| EP | 1028426 | A2 | 8/2000 |
| EP | 1 076 302 | | 2/2001 |
| EP | 1289197 | | 3/2003 |
| EP | 1 455 477 | | 9/2004 |
| EP | 1536612 | | 6/2005 |
| EP | 1566948 | | 8/2005 |
| GB | 1567238 | | 5/1980 |
| GB | 2137363 | | 10/1984 |
| GB | 2384399 | | 7/2003 |
| JP | 59-023610 | | 2/1984 |
| JP | 03-152469 | | 6/1991 |
| JP | 2000122044 | | 4/2000 |
| JP | 2000-224099 | | 8/2000 |
| JP | 2000-299834 | | 10/2000 |
| JP | 2001-312338 | | 11/2001 |
| JP | 2001321202 | | 11/2001 |
| JP | 2002-076977 | | 3/2002 |
| JP | 2002101908 | | 4/2002 |
| WO | WO 95/16950 | | 6/1995 |
| WO | WO 98/17032 | | 4/1998 |
| WO | WO 98/06466 | | 12/1998 |
| WO | WO 98/54581 | | 12/1998 |
| WO | WO 00/22820 | | 4/2000 |
| WO | WO 00/51259 | | 8/2000 |
| WO | WO 00/78170 | | 12/2000 |
| WO | WO 01/01706 | A1 | 4/2001 |
| WO | WO 01/33569 | | 5/2001 |
| WO | WO 01/65413 | | 9/2001 |
| WO | WO 01/67753 | | 9/2001 |
| WO | WO 02/25610 | | 3/2002 |
| WO | WO 03/023786 | | 3/2003 |
| WO | WO 03/067202 | | 8/2003 |
| WO | 2004/061850 | A1 | 7/2004 |
| WO | WO 2004/055637 | | 7/2004 |
| WO | WO2004/084413 | A2 | 9/2004 |
| WO | WO 2005/031737 | | 4/2005 |
| WO | WO 2005/048644 | | 5/2005 |
| WO | WO 2005/008505 | | 7/2005 |
| WO | WO 2005/109781 | | 11/2005 |
| WO | WO 2006071364 | | 6/2006 |
| WO | WO 2006/094380 | | 9/2006 |

WO WO 2007/022421 2/2007

OTHER PUBLICATIONS

"Apple Introduces iTunes—World's Best and Easiest to Use Jukebox Software," Macworld Expo, San Francisco, Jan. 9, 2001.
"Apple's iPod Available in Stores Tomorrow," Press Release, Apple Computer, Inc., Nov. 9, 2001.
"Nomad Jukebox," User Guide, Creative Technology Ltd., Version 1, Aug. 2000.
"SoundJam MP Plus Manual, version 2.0" —MP3 Player and Encoder for Macintosh by Jeffrey Robbin, Bill Kincaid and Dave Heller, manual by Tom Negrino, published by Casady & Greene, Inc., 2000.
"12.1" 925 Candela Mobile PC, downloaded from LCDHardware.com on Dec. 19, 2002, http://www.1cdharware.com/pane1/12_1_panel/default.asp.
"BL82 Series Backlit Keyboards", www.tg3electronics.corn/products/backlit/backlit.htm, downloaded Dec. 19, 2002.
"Bluetooth PC Headsets—Enjoy Wireless VoIP Conversations: 'Connecting' Your Bluetooth Headset With Your Computer", Bluetooth PC Headsets; downloaded on Apr. 29, 2006 from http://www.bluetoothpcheadsets.com/connect.htm.
"Creative MuVo TX 256 MB," T3 Magazine, Aug. 17, 2004, http://www.t3.co.uk/reviews/entertainment/mp3_player/creativemuvo_tx_256mb [downloaded Jun. 6, 2006].
"Digital Still Cameras—Downloading Images to a Computer," Mimi Chakarova et al., Multi-Media Reporting and Convergence, 2 pgs.
"Eluminx Illuminated Keyboard", downloaded Dec. 19, 2002, http://www.elumix.com/.
"How to Pair a Bluetooth Headset & Cell Phone", About.com; downloaded on Apr. 29, 2006 from http://mobileoffice.about.com/od/usingyourphone/ht/blueheadset_p.htm.
"Peripherals for Industrial Keyboards & Pointing Devices", Stealth Computer Corporation, downloaded on Dec. 19, 2002, http://www.stealthcomputer.com/peropherals_oem.htm.
"Poly-Optical Fiber Optic Membrane Switch Backlighting", downloaded Dec. 19, 2002, http://www.poly-optical.com/membrane_switches.html.
"Public Safety Technologies Tracer 2000 Computer", downloaded Dec. 19, 2002, http://www.pst911.com/traver.html.
"QuickTime Movie Playback Programming Guide", Apple Computer, Inc., Aug. 11, 2005.
"QuickTime Overview", Apple Computer, Inc., Aug. 11, 2005.
"Rocky Matrix Backlit Keyboard", downloaded Dec. 19, 2002, http://www.amrel.com/asi_matrixkeyboard.html.
"Sony Ericsson to introduce Auto pairing to improve Bluetooth connectivity between headsets and phones", Sep. 28, 2005 Press Release, Sony Ericsson Corporate; downloaded on Apr. 29, 2006 from http://www.sonyericsson.com/spg.jsp?cc=global&1c=en&ver=4001&template=pc3_1_1&z . . .
"Taos, Inc., Announces industry's First Ambient Light Sensor to Convert Light Intensity to Digital Signals", www.taosinc.com/pressrelease_090902.htm, downloaded Jan. 23, 2003.
"Toughbook 28: Powerful, Rugged and Wireless", Panasonic: Toughbook Models, downloaded Dec. 19, 2002, http:www.panasonic.com/computer/notebook/html/01a_s8.htm.
"When it Comes to Selecting a Projection TV, Toshiba Makes Everything Perfectly Clear, Previews of New Releases", www.bestbuy.com/HomeAudioVideo/Specials/ToshibaTVFeatures.asp, downloaded Jan. 23, 2003.
"WhyBuy: Think Pad", IBM ThinkPad Web Page Ease of Use, downloaded on Dec. 19, 2002, http://www.pc.ibm.com/us/thinkpad/easeofuse.html.
512MB Waterproof MP3 Player with FM Radio & Built-in Pedometer, Oregon Scientific, downloaded on Jul. 31, 2006 from http://www2.oregonscientific.com/shop/product.asp?cid=4&scid=11&pid=581.
Adam C. Engst, "SoundJam Keeps on Jarmmin'" Jun. 19, 2000, http://db.tidbits.com/getbits.acgi?tbart=05988.
Alex Veiga, "AT&T Wireless Launching Music Service," Yahoo! Finance, Oct. 5, 2004, pp. 1-2.
Andrew Birrell, "Personal Jukebox (PJB)," Oct. 13, 2000, http://birrell.org/andrew/talks/pjb-overview.ppt.
Apple iPod Technical Specifications, iPod 20GB and 60GB Mac+PC, downloaded from http://www.apple.com/ipod/color/specs.html on Aug. 8, 2005.
Bociurkiw, Michael, "Product Guide: Vanessa Matz,", www.forbes.com/asap/2000/1127/vmartz_print.html, Nov. 27, 2000.
Compaq, "Personal Jukebox," Jan. 24, 2001, http://research.compaq.com/SRC/pjb/.
Creative: "Creative NOmAD MuVo TX," www.creative.com, Nov. 1, 2004, http://web.archive.org/web/20041024175952/www.creative.com/products/pfriendly.asp?product=9672 [downloaded Jun. 6, 2006].
Creative: "Creative NOMAD MuVo," www.creative.com, Nov. 1, 2004, http://web.archive.org/web/20041024075901/www.creative.com/products/product.asp?category=213&subcategory=215&product=110 [downloaded Jun. 7, 2006].
Creative: "MP3 Player," www.creative.com, Nov. 1, 2004, http://web.archive.org/web/20041024074823/www.creative.com/products/product.asp?category=213&subcategory=216&product=4983 [downloaded Jun. 7, 2006].
De Herrera, Chris, "Microsoft ActiveSync 3.1," Version 1.02, Oct. 13, 2000.
iAP Sports Lingo 0x09 Protocol V1.00, May 1, 2006.
IEEE 1394—Wikipedia, 1995, littp://www.wikipedia.org/wiki/Firewire.
Written Opinion of the International Searching Authority dated Nov. 24, 2006 in PCT Application No. PCT/US2005/046797.
International Search Report dated Feb. 4, 2003 in corresponding application No. PCT/US2002/033330.
International Search Report dated Jul. 10, 2007 in corresponding application No. PCT/US2006/048738.
International Search Report dated Apr. 5, 2006 from corresponding International Application No. PCT/US2005/038819.
International Search Report dated Jul. 2, 2007 in related case PCT/US2006/048669.
International Search Report dated Jun. 19, 2007 in related Application PCT/US2006/048753.
International Search Report dated May 21, 2007 from corresponding PCT Application No. PCT/US2006/048670.
International Search Report in corresponding European Application No. 06256215.2 dated Feb. 20, 2007.
Invitation to Pay Additional Fees and Partial Search Report for corresponding PCT Application No. PCT/US2005/046797 dated Jul. 3, 2006.
iTunes 2, Playlist Related Help Screens, iTunes v2.0, Apple Computer, Inc., Oct. 23, 2001.
iTunes, Playlist Related Help Screens, iTunes v1.0, Apple Computer, Inc., Jan. 2001.
Jabra Bluetooth Headset User Manual; GN Netcom A/s, 2005.
Jabra Bluetooth Introduction; GN Netcom A/S, Oct. 2004.
Jabra FreeSpeak BT200 User Manual; Jabra Corporation, 2002.
Kennedy, "Digital Data Storage Using Video Disc," IBM Technical Disclosure Bulletin, vol. 24, No. 2, Jul. 1981.
Miniman, "Applian Software's Replay Radio and Player v1.02," Product review, pocketnow.com, http://www.pocketnow.com/reviews/replay/replay.htm, Jul. 31, 2001.
Musicinatch, "Musicmatch and Xing Technology Introduce Musicrnatch Jukebox," May 18, 1998, http://www.musicmatch.com/info/companylpress/releases/?year=1998&release=2.
Nonhoff-Arps, et al., "Straβenmusik Portable MP3-Spieler mit USB-Anschluss," CT Magazin Fuer Computer Technik, Verlag Heinz Heise GMBH, Hannover DE, No. 25, Dec. 4, 2000.
International Search Report dated Nov. 24, 2006 in PCT Application No. PCT/US2005/046797.
Personal Jukebox (PJB), "Systems Research Center and PAAD," Compaq Computer Corp., Oct. 13, 2000, http://research.compaq.com/SRC/pjb/.
Peter Lewis, "Two New Ways to Buy Your Bits," CNN Money, Dec. 31, 2003, pp. 1-4.

Sastry, Ravindra Wadali. "A Need for Speed: A New Speedometer for Runners", submitted to the Department of Electrical Engineering and Computer Science at the Massachusetts Institute of Technology, May 28, 1999.
Sinitsyn, Alexander. "A Synchronization Framework for Personal Mobile Servers," Pervasice Computing and Communications Workshops, 2004. Proceedings of the Second IEEE Annual Conference on, Piscataway, NJ, USA, IEEE, Mar. 14, 2004, pp. 208-212.
SoundJam MP Plus, Representative Screens, published by Casady & Greene, Inc., Salinas, CA, 2000.
Specification Sheet, iTunes 2, Apple Computer, Inc., Oct. 31, 2001.
Spiller, Karen. "Low—decibel earbuds keep noise at a reasonable level", The Telegraph Online, dated Aug. 13, 2006, http://www.nashuatelegraph.com/apps/pbcs.d11/article?Date=20060813&Cate . . . Downloaded Aug. 16, 2006.
Steinberg, "Sonicblue Rio Car," Product Review, Dec. 12, 2000, http://electronics.cnet.com/electronics/0-6342420-1304-4098389.html.
Travis Butler, "Archos Jukebox 6000 Challenges Nomad Jukebox," Augus 13, 2001, http://db.tidbits.com/getbits.acgi?tbart=(06521.
Travis Butler, "Portable MP3: The Nomad Jukebox," Jan. 8, 2001, http://db.tidbits.com/getbits.acgi?tbart=06261.
U.S. Appl. No. 11/621,541, "Personalized Podcasting Podmapping" filed Jan. 9, 2007.
Waterproof Music Player with FM Radio and Pedometer User Manual, Oregon Scientific, 2005.
U.S. Appl. No. 10/125,893, filed Apr. 18, 2002 and titled "Power Adapters for Powering and/or Charging Peripheral Devices.".
International Search Report dated Dec. 5, 2007 in PCT Application No. PCT/US2007/004810.
Written Opinion dated Dec. 5, 2007 in PCT Application No. PCT/US2007/004810.
Partial Search Report dated Sep. 6, 2007 in PCT Application No. PCT/US2007/004810.
International Search Report dated Dec. 6, 2007 in PCT Application No. PCT/US2007/010888.
Written Opinion dated Dec. 6, 2007 in PCT Application No. PCT/US2007/010888.
Apple iTunes Smart Playlists, downloaded Apr. 5, 2005 from http://web.archive.org/web/20031002011316/www.apple.com/itunes/smartplaylists...pp. 1-2.
Hart-Daves, Guy, "How to Do Everything with Your IPod & Mini IPod Mini", 2004, McGraw-Hill Professional, p. 33.
International Search Report in Patent Application No. PCT/US2006/048738 dated Jan. 29, 2008.
International Search Report in Patent Application No. PCT/US2007/077020 dated Jan. 28, 2008.
International Search Report in Patent Application No. PCT/US2007/076889 dated Jan. 28, 2008.
iTunes, Wikipedia, the free encyclopedia; downloaded on Oct. 5, 2005, pp. 1-6.
Nutzel et al., "Sharing Systems for Future HiFi Systems", The Computer Society, Jun. 2004.
Office Action Dated Feb. 1, 2008 in U.S. Appl. No. 11/327,544.
Office Action Dated Feb. 4, 2008 in U.S. Appl. No. 11/566,072.
Written Opinion in Patent Application No. PCT/US2006/048738 dated Jan. 29, 2008.
Written Opinion in Patent Application No. PCT/US2007/076889 dated Jan. 28, 2008.
Written Opinion in Patent Application No. PCT/US2007/077020 dated Jan. 28, 2008.
Partial Search Report and Invitation to Pay Fees dated Apr. 8, 2008 in PCT Application No. PCT/US2007/012033.
EP98928854.3 Supplementary Search Report Feb. 18, 2002.
EP989288543 Supplementary European Search Report; Feb. 18, 2002.
PCT/US98/11268 International Search Report mailed Jan. 11, 1999.
PCT/US00/18237 International Search Report; Oct. 17, 2000.
PCT/US01/51620 International Search Report mailed Sep. 25, 2002.
PCT/US00/18237 International Preliminary Examination Report; Sep. 11, 2003.
Civil Action No. 05-CV-02323; Complaint, Nov. 16, 2005.
Civil Action No. 06-CV-01100-WDM-PAC, Complaint, Jun. 8, 2000.
Civil Action No. 06-CV-01100-WDM-PAC, Defendants Polar Electro Inc.'s And Polar Electro Oy's Answer And Affirmative Defenses: Polar Electro Inc.'Counterclaim and Demand For Jury Trial, Jun. 29, 2006.
Civil Action No. 06-CV-01447-MSK-BNB, Complaint, Jul. 26, 2006.
Civil Action No. 06-Cv-01447 MSK-BNB, First Amended Complaint; Aug. 16, 2006.
Civil Action No. 06-CV-01447-MSK-BNB, Answer, Affirmative Defenses, Counterclaim, And Demand For Jury Trial, Garmin; Sep. 26, 2006.
Civil Action No. 06-CV-01447-MSK-BNB; Garmin Disclosure Statement; Sep. 26, 2006.
Civil Action No. 06-CV-01447 MSK-BNB, Answer, Affirmative Defenses, Counterclaims and Demand for Jury Trial, Timex; Sep. 26, 2006.
Civil Action No. 06-CV-01447-MSk-BNB; Timex Disclosure Statement; Sep. 26, 2006.
Civil Action No. 06-CV-01447-MSK-BNB: PhatRat Technology, Inc.'s Supplemental Answers and Objections to Defendant, Timex Corporation's Interrogatories Nos. 1, 2, 5, 7-11, 13 and 15; Feb. 12, 2007.
Civil Action No. 06-CV-02122-REB-MJW, Complaint, Oct. 24, 2006.
Civil Action No. 06-CV-02122-REB-MJW, Apple Computer, Inc.'s Answer to Complaint and Counterclaims, Jan. 22, 2007.
Civil Action No. 07-CV-00078-MSK-BNB, Complaint, Jan. 12, 2007.
Civil Action No. 07-Cv-00078-MSK-BNB, Answer, Feb. 9, 2007.
Civil Action No. 07-CV-00238-REB-PAC, Complaint, Mar. 19, 2007.
Civil Action No. 07-CV-00238-REB, Apple Inc.'s Answer to Complaint, Counterclaims and Jury Demand, Mar. 19, 2007.
Civil Action No. 07-CV-00238; Nike Inc.'s Answer, Affirmative Defenses to First Complaint, Mar. 19, 2007.
U.S. Appl. No. 08/764,758, Office Action mailed Aug. 21, 1997.
U.S. Appl. No. 08/764,758, Response to Office Action mailed Aug. 21, 1997.
U.S. Appl. No. 08/764,758, Office Action mailed Dec. 15, 1998.
U.S. Appl. No. 08/764,758, Response to Office Action mailed Dec. 15, 1998.
U.S. Appl. No. 08/764,758, Office Action mailed May 8, 1998.
U.S. Appl. No. 08/764,758, Response to Office Action mailed May 8, 1998, filed Oct. 8, 1998.
U.S. Appl. No. 08/764,758, Notice of Allowance mailed Jun. 1, 1999.
U.S. Appl. No. 08/764,758, Advisory Action mailed Apr. 29, 1999.
U.S. Appl. No. 08/867,083, Office Action mailed Apr. 8, 1999.
U.S. Appl. No. 08/764,758, Rule 116 Amendment filed Apr. 8, 1999.
U.S. Appl. No. 08/764,758, Rule 116 Amendment filed May 13, 1999.
U.S. Appl. No. 08/867,083, Response to Office Action mailed Apr. 8, 1999.
U.S. Appl. No. 08/867,083, Supp. Response to Office Action mailed Apr. 8, 1999.
U.S. Appl. No. 08/867,083, Final Office Action mailed Jan. 3, 2000.
U.S. Appl. No. 08/867,083, Notice of Appeal mailed Jan. 3, 2000.
U.S. Appl. No. 08/867,083, Notice of Appeal Response to Office Action mailed Jan. 3, 2000.
U.S. Appl. No. 08/867,083, Advisory Action mailed Mar. 14, 2000.
U.S. Appl. No. 08/867,083 Office Action mailed Jun. 26, 2000.
U.S. Appl. No. 08/867,083 Amendment response to Office Action mailed Jun. 26, 2000.
U.S. Appl. No. 08/867,083 Notice of Allowance, mailed Feb. 6, 2001.
U.S. Appl. No. 09/089,232, Information Disclosure Statement mailed Oct. 23, 1998.
U.S. Appl. No. 09/089,232, Office Action mailed Nov. 27, 1998.
U.S. Appl. No. 09/089,232, Office Action mailed May 30, 2000.
U.S. Appl. No. 09/089,232, Preliminary Amendment response to Office Action mailed May 30, 2000.
U.S. Appl. No. 09/089,232, Office Action mailed Dec. 19, 2000.

U.S. Appl. No. 09/089,232, Response to Office Action mailed Dec. 19, 2000.
U.S. Appl. No. 09/089,232, Office Action mailed Aug. 8, 2001.
U.S. Appl. No. 09/089,232, Notice of Appeal mailed Nov. 5, 2001.
U.S. Appl. No. 09/089,232, Notice of Appeal mailed Nov. 7, 2001.
U.S. Appl. No. 09/089,232, Appeal Brief mailed Jan. 2, 2002.
U.S. Appl. No. 09/089,232, Office Action mailed Apr. 26, 2002.
U.S. Appl. No. 09/089,232, Appeal Brief mailed Jul. 26, 2002.
U.S. Appl. No. 09/089,232, Notice of Allowance mailed Oct. 2, 2002.
U.S. Appl. No. 09/089,232, Conunents on Allowance mailed Oct. 16, 2002.
U.S. Appl. No. 09/089,232, Office Action mailed Jan. 27, 2003.
U.S. Appl. No. 09/698,659, Office Action mailed Mar. 19, 2002.
U.S. Appl. No. 09/698,659, Response to Office Action of Mar. 19, 2002.
U.S. Appl. No. 09/698,659, Office Action mailed Nov. 21, 2002.
U.S. Appl. No. 09/698,659, Response to Office Action of Nov. 21, 2002.
U.S. Appl. No. 09/698,659, Notice of Allowance mailed Apr. 9, 2003.
U.S. Appl. No. 09/848,445, Preliminary Amendment mailed Dec. 5, 2001.
U.S. Appl. No. 09/848,445, Office Action mailed Dec. 5, 2003.
U.S. Appl. No. 09/848,445, Response to Office Action mailed Dec. 5, 2003.
U.S. Appl. No. 09/848,445, Office Action mailed May 6, 2004.
U.S. Appl. No. 09/848,445, Response to Office Action (Rule 116) mailed Jun. 5, 2004.
U.S. Appl. No. 09/886,578, Preliminary Amendment mailed Jun. 21, 2001.
U.S. Appl. No. 09/886,578, Office Action mailed Nov. 8, 2001.
U.S. Appl. No. 09/886,578, Response to Office Action mailed Nov. 8, 2001.
U.S. Appl. No. 09/886,578, Office Action mailed Jun. 5, 2002.
U.S. Appl. No. 09/886,578, Response to Office Action mailed Jun. 5, 2002.
U.S. Appl. No. 09/886,578, Notice of Allowance mailed Sep. 9, 2002.
U.S. Appl. No. 09/992,966, Office Action mailed Feb. 3, 2003.
U.S. Appl. No. 09/992,966, Response to Office Action mailed Feb. 3, 2003.
U.S. Appl. No. 09/992,966, Office Action mailed Mar. 28, 2002.
U.S. Appl. No. 09/992,966, Response to Office Action mailed Mar. 28, 2002.
U.S. Appl. No. 09/992,966, Office Action mailed Jul. 18, 2003.
U.S. Appl. No. 09/992,966, Response to Office Action mailed Jul. 18, 2003.
U.S. Appl. No. 09/992,966, Examiner Summary mailed Oct. 27, 2003.
U.S. Appl. No. 09/992,966, Notice of Allowance mailed Apr. 15, 2004.
U.S. Appl. No. 09/992,966, Office Action mailed Jan. 6, 2004.
U.S. Appl. No. 09/992,966, Response to Office Action mailed Jan. 6, 2004.
U.S. Appl. No. 09/992,966, Notice of Allowance mailed Sep. 3, 2004.
U.S. Appl. No. 10/234,660, Office Action mailed Mar. 31, 2003.
U.S. Appl. No. 10/234,660, Response to Office Action mailed Mar. 31, 2003.
U.S. Appl. No. 10/234,660, Final Office Action mailed Oct. 31, 2003.
U.S. Appl. No. 10/234,660, 12/23/03 Response to Office Action mailed Oct. 31, 2003.
U.S. Appl. No. 10/234,660 Response and Amendment Under 37 CFR Section 1.116 mailed Oct. 31, 2003.
U.S. Appl. No. 10/234,660; Advisory Action mailed Jan. 27, 2004.
U.S. Appl. No. 10/234,660; Appeal Brief filed Jun. 14, 2004.
U.S. Appl. No. 10/234,660; Amendment filed Jul. 20, 2004.
U.S. Appl. No. 10/234,660; Marked up Claims by USPTO dated Jul. 28, 2004.
U.S. Appl. No. 10/234,660; Notice of Allowance; Aug. 2, 2004.
U.S. Appl. No. 10/297,270 Office Action mailed Jul. 29, 2004.
U.S. Appl. No. 10/297,270 Response to Office Action mailed Jul. 29, 2004.
U.S. Appl. No. 10/297,270 Office Action mailed Dec. 13, 2004.
U.S. Appl. No. 10/297,270 Response to Office Action mailed Dec. 13, 2004.
U.S. Appl. No. 10/297,270 Request Deletion of Named Inventors Pursuant to 37 CFR § 1.63 (d)(2) received by the Patent Office on Oct. 4, 2002.
U.S. Appl. No. 10/297,270 Office Action mailed Jul. 13, 2005.
U.S. Appl. No. 10/297,270 Response to Office Action mailed Jul. 13, 2005.
U.S. Appl. No. 10/297,270 Office Action mailed Feb. 9, 2006.
U.S. Appl. No. 10/297,270 Response to Office Action mailed Feb. 9, 2006.
U.S. Appl. No. 10/297,270 Office Action mailed Sep. 25, 2006.
U.S. Appl. No. 10/297,270 Response to Office Action mailed Sep. 25, 2006.
U.S. Appl. No. 10/297,270 Office Action mailed Jan. 11, 2007.
U.S. Appl. No. 10/297,270 Response to Office Action mailed Jan. 11, 2007.
U.S. Appl. No. 10/297,270 Office Action mailed Jul. 26, 2007.
U.S. Appl. No. 10/297,270 Response to Office Action mailed Jul. 26, 2007.
U.S. Appl. No. 10/601,208 Preliminary Amendment, mailed Jun. 20, 2003.
U.S. Appl. No. 10/601,208 Office Action mailed Jun. 15, 2004.
U.S. Appl. No. 10/601,208 Response to Office Action mailed Jun. 15, 2004.
U.S. Appl. No. 10/601,208 Office Action mailed Aug. 26, 2004.
U.S. Appl. No. 10/601,208 Response to Office Action mailed Aug. 26, 2004.
U.S. Appl. No. 10/601,208 Second Response to Office Action mailed Aug. 26, 2004.
U.S. Appl. No. 10/601,208 Office Action mailed May 11, 2005.
U.S. Appl. No. 10/601,208 Response to Office Action mailed May 11, 2005.
U.S. Appl. No. 10/601,208 Office Action mailed Feb. 15, 2006.
U.S. Appl. No. 10/601,208 Response to Office Action mailed Feb. 15, 2006.
U.S. Appl. No. 10/601,208 Office Action mailed Sep. 26, 2006.
U.S. Appl. No. 10/601,208 Response to Office Action mailed Sep. 26, 2006.
U.S. Appl. No. 10/601,208 Notice of Allowance mailed Dec. 8, 2006.
U.S. Appl. No. 10/842,947, Preliminary Amendment mailed May 11, 2004.
U.S. Appl. No. 10/842,947, Office Action mailed Nov. 30, 2004.
U.S. Appl. No. 10/842,947, Response to Office Action mailed Nov. 30, 2004.
U.S. Appl. No. 10/842,947, Office Action mailed Jun. 30, 2005.
U.S. Appl. No. 10/842,947, Response to Office Action mailed Jun. 30, 2005.
U.S. Appl. No. 10/842,947, Notice of Allowance mailed Feb. 9, 2006.
U.S. Appl. No. 10/921,743; Office Action mailed Mar. 4, 2005.
U.S. Appl. No. 10/921,743; Response to Office Action mailed Mar. 4, 2005.
U.S. Appl. No. 10/921,743; Office Action mailed May 26, 2005.
U.S. Appl. No. 10/921,743; Response to Office Action mailed May 26, 2005.
U.S. Appl. No. 10/921,743; Office Action mailed Sep. 13, 2005.
U.S. Appl. No. 10/921,743; Advisory mailed Nov. 25, 2005.
U.S. Appl. No. 10/921,743; Response to Office Action mailed Sep. 13, 2005 and Advisory mailed Nov. 25, 2005.
U.S. Appl. No. 10/921,743; Notice of Allowance; Feb. 16, 2006.
U.S. Appl. No. 10/950,897, Notice of Allowance mailed Feb. 13, 2005.
U.S. Appl. No. 10/950,897, Office Action mailed Mar. 7, 2005.
U.S. Appl. No. 10/950,897, Response to Office Action mailed Mar. 7, 2005.
U.S. Appl. No. 10/950,897, Office Action mailed Jun. 23, 2005.
U.S. Appl. No. 10/950,897, Response to Office Action mailed Jun. 23, 2005.
U.S. Appl. No. 10/950,897, Office Action mailed Sep. 9, 2005.
U.S. Appl. No. 10/950,897, Response to Office Action mailed Sep. 9, 2005.
U.S. Appl. No. 10/950,897, Office Action mailed Nov. 25, 2005.
U.S. Appl. No. 10/950,897, Response to Office Action mailed Nov. 25, 2005.

U.S. Appl. No. 10/950,897, Amendment to Notice of Allowance mailed Dec. 13, 2005.
U.S. Appl. No. 11/221,029; Preliminary Amendment dated Aug. 22, 2006.
U.S. Appl. No. 11/221,029; Office Action mailed Sep. 8, 2006.
U.S. Appl. No. 11/221,029; Response to Office Action mailed Sep. 8, 2006.
U.S. Appl. No. 11/221,029; Notice of Allowance; Oct. 3, 2006.
U.S. Appl. No. 11/252,576; Notice of Allowance; Dec. 11, 2007.
U.S. Appl. No. 11/358,508; Notice of Non Compliance mailed Sep. 12, 2006.
U.S. Appl. No. 11/358,508, Preliminary Amendment mailed Mar. 30, 2006.
U.S. Appl. No. 11/358,508, Preliminary Amendment mailed May 30, 2006.
U.S. Appl. No. 11/358,508, Preliminary Amendment mailed Jul. 26, 2006.
U.S. Appl. No. 11/358,508, Office Action mailed Aug. 14, 2006.
U.S. Appl. No. 11/358,508, Response to Office Action mailed Aug. 14, 2006.
U.S. Appl. No. 11/358,508. Notice of Non Compliance Amendment mailed Sep. 12, 2006.
U.S. Appl. No. 11/358,508, Response to Notice mailed Sep. 12, 2006.
U.S. Appl. No. 11/358,508, Notice of Allowability & Interview Summary mailed Oct. 18, 2006.
U.S. Appl. No. 11/358,508, Rule 312 Amendment mailed Oct. 24, 2006.
U.S. Appl. No. 11,434,588: Office Action mailed Jan. 31, 2007.
U.S. Appl. No. 11,434,588; Response to Office Action mailed Jan. 31, 2007.
U.S. Appl. No. 11,434,588; Notice of Allowance; Jul. 11, 2007.
U.S. Appl. No. 11,434,588; Notice of Allowance; Nov. 6, 2007.
U.S. Appl. No. 11/484,199 Preliminary Amendment; Sep. 7, 2006.
U.S. Appl. No. 11/484,199 Notice of Allowance and Examiner Interview Summary; Oct. 6, 2006.
U.S. Appl. No. 11/598,410, Office Action mailed Jun. 13, 2007.
U.S. Appl. No. 11/598,410 Response to Office Action mailed Jun. 13, 2007.
U.S. Appl. No. 11/598,410, Notice of Allowability Sep. 26, 2007.
U.S. Appl. No. 11/646,768, Office Action mailed May 7, 2007.
U.S. Appl. No. 11/646,768, Response to Office Action mailed May 7, 2007.
U.S. Appl. No. 11/646,768, Office Action mailed Oct. 29, 2007.
U.S. Appl. No. 11/646,768, Response to Office Action mailed Oct. 29, 2007.
U.S. Appl. No. 11/646,768; Notice of Allowance; Jan. 18, 2008.
U.S. Appl. No. 11/747,081; Office Action mailed Jan. 24, 2008.
Cole, George, "The Little Label with an Explosion of Applications", Financial Times, Ltd., 2002, pp. 1-3.
Deem, "Fast Forward Go for a Ride on the World's Fastest Sailboat", Popular Mechanics, www.popularmechanics.com, Feb. 2001, pp. 1-2.
Desmarais, "Solutions in Hand", BEI Technologies, Inc., www.sensormag.com, Jan. 2001, pp. 1-2.
Desmarais et al., "How to select and use the right temperature," www.sensorsmag.com, Jan. 2001, pp. 30-36.
GPS Locator for Children, Klass Kids Foundation Jul. 15, 2004.
Henkel, Research & Developments, *Sensors*, Nov. 2000. p. 18.
Janssens et al., "Columbus: A Novel Sensor System for Domestic Washing Machines", *Sensors Magazine* Online, Jun., 2002 , pp. 1-9.
Licking, Special Report: E-Health, "This is the Future of Medicine", Business Week E.Biz, Dec. 11, 2000, pp. 77 and 78 US.
Li-Ron, Tomorrow's Cures, Health & Fitness Special Section Online, Newsweek, Dec. 10, 2001, pp. 3-10.
Mark of Fitness Flyer, "High Quality, Self-Taking Blood Pressure Monitors", four pages, Shrewsbury, NJ, US.
Martella, Product News, "Temperature Monitoring System", Nov. 2000, p. 77.
Nobbe, "Olympic Athletes Get a Boost from Technology", *Machine Design*, vol. 60, No. 19, Aug. 25, 1988.
Paradiso et al., Design and Implementation of Expressive Footwear, May 12, 2000, IBM Systems Journal, vol. 39, Nos. 3&4, pp. 511-529.
Paradiso, et al. "Instrumented Footwear for Interactive Dance" Version 1.1, Presented at the XII Colloquium on Musical Informatics, Gorizia, Italy, Sep. 24-26, 1998, pp. 1-4.
Sellers. Gear to Go, Mitch Mandel Photography, Mar. 2001, pp. 61-62.
Shannon P. Jackson and Harold Kirkham, "Weighing Scales Based on Low-Power Strain-Gauge Circuits", Nasa Tech Briefs, Jun. 2001, p. 49 US.
Sharp, A Sense of the Real World, www.idsystems.com/reader/2000_09/sens0900.htm, Sep., 2000, 4 pages.
Skaloud et al., DGPS-Calibrated Accelerometric System for Dynamic Sports Events, Sep. 19-22, 2000, ION GPS 2000.
Smith et al., "Flexible and Survivable Non-Volatile Memory Data Recorder", AFRL Technology Horizons, Dec. 2000, p. 26.
Webster's II New Riverside University Dictionary, 1988, The Riverside Publishing Company, p. 1138. (cited by examiner).
Wysocki, Jr., Staff Reporter, "Do Devices Measuring Body Signs Appeal to the Sick or Healthy", Pittsburgh, US.
No author listed, "Your Next . . . ", *Newsweek*, Jun. 25, 2001, p. 52 US.
No author listed, The GPS Connection, *Popular Mechanics*, Feb. 2001, p. 65.
No author listed, WarmMark Time Temperature Indicators, www.coldice.com/warmmark_temperature_indicators.html, Cold Ice., Inc.
No author listed, Wireless Temperature Monitor, www.echo-on.net/mob/, Nov. 20. 2000.
Unattributed, 3M MonitorMark Indicator Data Sheet [online), [retrieved on Aug. 9, 2004], retrieved from the Internet: URL: http://www.3m.com/us/healthcare/medicalspecialties/monitor/products.html; 4 pages.
International Search Report dated Jul. 7, 2008 in PCT Application No. PCT/US2007/012033.
Written Opinion dated Jul. 7, 2008 in PCT Application No. PCT/US2007/012033.
Office Action dated May 13, 2009 in U.S. Appl. No. 11/585,721.
Office Action dated Apr. 14, 2009 in U.S. Appl. No. 11/439,523.
Office Action dated Oct. 29, 2008 in U.S. Appl. No. 11/566,072.
Office Action dated Mar. 4, 2009 in U.S. Appl. No. 11/513,616.
Notice of Allowance dated Oct. 8, 2009 in U.S. Appl. No. 11/439,523.
Office Action dated Sep. 4, 2009 in U.S. Appl. No. 11/585,721.
Office Action dated Aug. 20, 2009 in U.S. Appl. No. 11/513,616.

* cited by examiner

Running style profile template

SMART GARMENT

CROSS REFERENCE TO RELATED APPLICATIONS

This application is related to i) U.S. patent application Ser. No. 11/439,521, filed May 22, 2006, and entitled "COMMUNICATION PROTOCOL FOR USE WITH PORTABLE ELECTRONIC DEVICES" and ii) U.S. patent application Ser. No. 11/419,737, filed May 22, 2006, and entitled "INTEGRATED MEDIA JUKEBOX AND PHYSIOLOGIC DATA HANDLING APPLICATION" each of which are hereby incorporated by reference herein in their entirety for all purposes.

FIELD OF THE INVENTION

The invention relates generally to performance monitoring. More particularly, methods and apparatus electronically pairing an authorized garment and a sensor that receives data from the garment are disclosed.

DESCRIPTION OF RELATED ART

The use of devices to obtain exercise performance information is known. For example, simple mechanical pedometers have been used to obtain information relating to walking or running. A typical mechanical pedometer is a standalone device merely displays an indication of number of steps taken which, typically at most, can be converted to distance traveled by multiplying the number of steps taken by an estimated average stride distance.

More sophisticated devices are also known. For example, as described in U.S. Pat. No. 6,898,550 (the '550 patent), a foot-mounted unit, including a sensor for sensing motion of the foot of a user, is configured to provide motion information—wirelessly—to a wrist-device. The wrist device includes a display for displaying information to the user based upon data accumulated by the foot-mounted unit and transmitted wirelessly to the wrist device. In addition, as described in the '550 patent, the wrist device can be coupled to a computer and/or a network server via a network. The user can operate software running on the computer and/or the server to analyze received data and/or to select operating parameters for the wrist device and/or the foot-mounted unit.

Unfortunately, however, it is becoming more commonly practiced to place the sensor at locations on a garment (shoes, for example) that are not specifically designed to physically accommodate the sensor and/or calibrated to accurately reflect data supplied to the wrist device. For example, Nike Inc. and Apple Inc. have joined forces to provide what is referred to as the Nike iPod Sport Kit™ that is a wireless device kit that allows communication between a pair of specially configured Nike+™ shoes and an iPod nano™. The Nike iPod Sport Kit™ is arranged such that at least one of the Nike+™ shoes includes a sensor (that includes an accelerometer/transmitter) mounted under the inner sole and a receiver that communicates with the iPod nano™. In order to accommodate the sensor and provide appropriate data to the iPod nano™, the shoe must be a Nike+™ model with a special pocket in which to place the sensor. However, some people have taken it upon themselves to remove the sensor from the special pocket of the Nike+™ shoe and place it at inappropriate locations (shoelaces, for example) or place it on non-Nike+™ model shoes.

Therefore, what is desired is a method of electronically pairing a sensor and an authorized garment.

SUMMARY

An embodiment of this invention pertains to linking an authenticated sensor with one or more authorized garments (such as running shoes, shirts, slacks, etc.) that can provide in addition to current physiologic data of the user, garment performance statistics (i.e., rate of wear of a running shoe), location of the garment and any related information (location of near-by eating establishments, for example) and any other garment related data. In one embodiment, the sensor can be authenticated for use with a particular garment using, for example, an identification device (such as an RFID type device). In this way, only an authenticated sensor can be used to provide information to the wearer of the garment.

The invention can be implemented in numerous ways, including as a method, system, or computer readable medium. Several embodiments of the invention are discussed below. One embodiment of the invention is a method of electronically pairing a sensor and a garment. The method can include, for example, at least: establishing a communication link between the sensor and the garment and electronically pairing the garment and the sensor only if the garment is authorized to be paired with the sensor.

As computer program product, another embodiment of the invention includes at least: computer code for establishing a communication link between the sensor and the garment, computer code for determining if the garment is an authorized garment, and computer code for electronically pairing the garment and the sensor only if the garment is authorized to do so.

As an electronic consumer product system, yet another embodiment of the invention includes, for example, at least: a sensor, and a garment electronically paired with the sensor, wherein the sensor receives data from the garment and passes a portion of the data to an external circuit for further processing.

Other aspects and advantages of the invention will become apparent from the following detailed description, taken in conjunction with the accompanying drawings, illustrating by way of example the principles of the invention.

DETAILED DESCRIPTION

Figure 1:
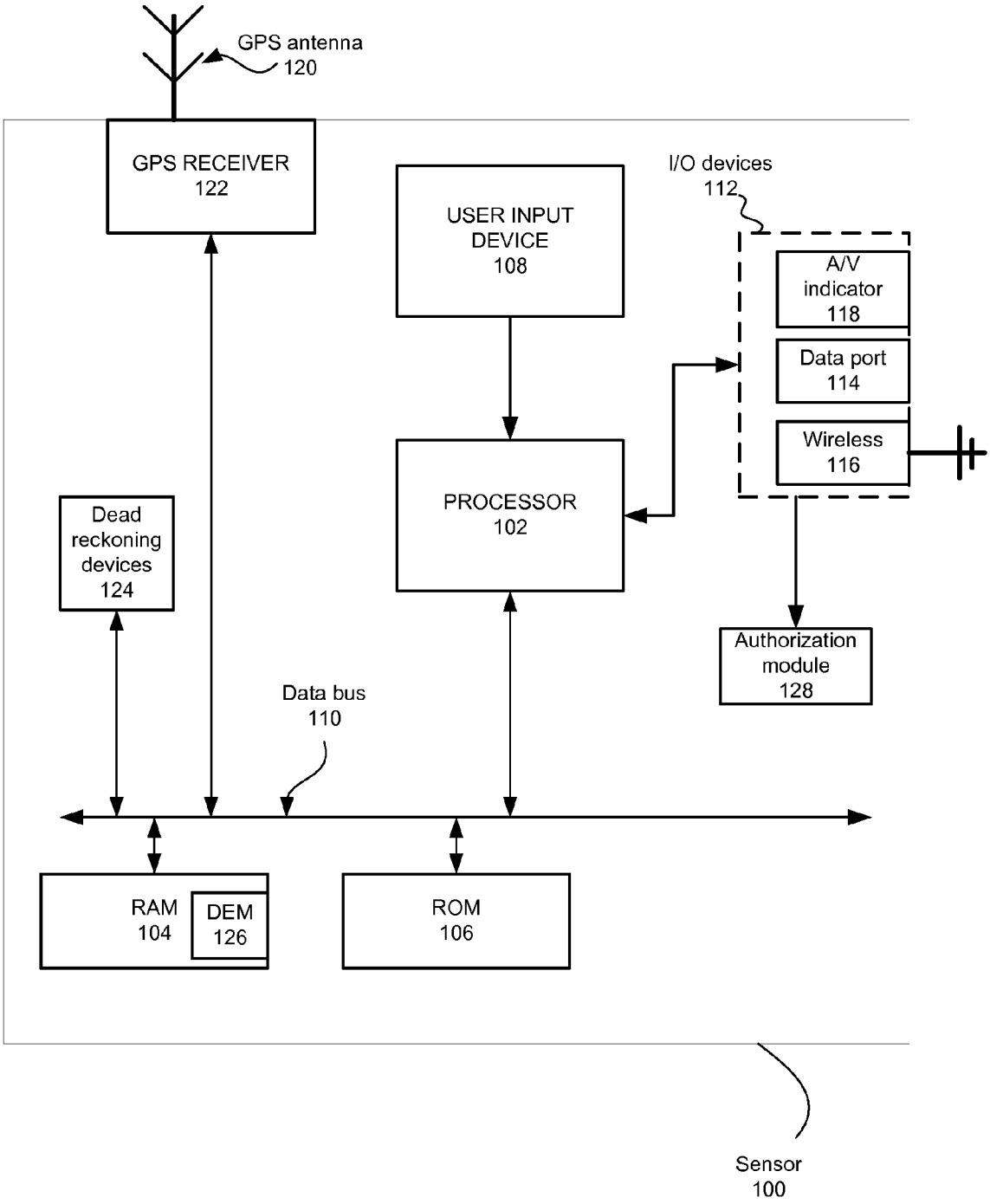
FIG. 1 illustrates an example of a physiologic data-gathering device (sensor) in the form of sensor in accordance with an embodiment of the invention.

Reference will now be made in detail to selected embodiments of the invention an example of which is illustrated in the accompanying drawings. While the invention will be described in conjunction with selected embodiments, it will be understood that it is not intended to limit the invention to one particular embodiment. To the contrary, it is intended to cover alternatives, modifications, and equivalents as may be included within the spirit and scope of the invention as defined by the appended claims.

Outdoors endurance activities have become very popular not only because they are enjoyable and healthy, but also because they provide opportunities for competition, camaraderie, and a structured regimen. It would be beneficial for an individual participating in an outdoor endurance activity such as running, cross-country skiing, in-line skating, or outdoor swimming to be able to monitor his or her performance in metrics such as speed, distance, slope, elevation, equipment used (thereby correlating an individual's performance to particular running shoes, for example). Furthermore, as part of a particular training program, a user will want to be able to keep track of his or her performance for a particular event as well as be able to store the information for later comparison with subsequent athletic events. For example, if a runner desires to track his or her performance over a period of time, various physical characteristics of the runner, such as age, weight, and gender, for example, could be used to evaluate the runner's performance against both his or her individual performances. In addition to being able to gauge their own particular athletic performances against their own historical record, a user might also like to be able to compare his or her own performance against a reference performance typical of, for example, a person having similar physical characteristics. In this way, a user could gauge his or her own athletic prowess and abilities against an accepted reference and be able to determine, for example, the performance percentile he or she falls in relation to his or her particular cohort of runners.

In addition to being able to ascertain one's own performance against a hypothetical norm, a user may also like to be able to compete against others. Such competitions historically have been held in meets, or other local physical competitions where athletes meet in person and compete. It would also be desirable to be able to compete against an opponent even in those situations where both opponents cannot be physically in the same location using a network such as the Internet. However, being able to track each individual, until recently, has been impractical. In addition, it would be beneficial to be able to correlate a user's performance to particular garments (running time vs. a particular shoe or shoe design) as well as tracking shoe characteristics (such as wear) over time or distance used.

The described embodiments provide an improved method, apparatus and system for automatic monitoring in real-time athletic performance of a user utilizing an authenticated sensor electronically paired with an authorized garment worn by the user in communication with (either wirelessly or wired) an external processing device. As used herein an authorized garment is a garment sanctioned to be electronically paired with an authenticated (i.e., certified) sensor. Once the garment and sensor are electronically paired, the sensor can receive (and in some cases process) sensing information (such as garment performance data or user performance data) received from the garment. Since only authorized garments are configured to electronically pair with authenticated sensors, a user (or manufacturer) can be assured that the sensing data received by the sensor is both accurate and consistent with its intended use (a sensor designed for use with running shoes can not properly be used with dance shoes, for example). In the case of running shoes, if a user owns a number of running shoes, he or she may want to determine if a particular shoe or shoe design facilitates superior performance by the user, determine which shoe design provides for better wear, evaluate a particular shoe against other shoes of similar design, and so on.

Improved security can be provided by authenticating the sensor to only a limited number of garments (such as running shoes) as determined by a user, shoe manufacturer, etc. thereby reducing the incentive for thieves to steal the sensor or finders of lost sensors to keep them. Since the sensor will function properly with only authorized garments, a thief (or recalcitrant finder) can use the sensor only if it is properly authenticated and only then with authorized garments thereby markedly reducing the incentive to steal (or keep) the sensor resulting in vastly improved security than would otherwise be possible.

Furthermore, in addition to performance and improved security, a sensor can provide notification to a user that a particular garment has reached an expected useful lifetime based upon any number of factors, such as, an amount of time that the garment has been used, an amount of wear detected by the sensor, etc. For example, in many cases, a runner will not notice that a running shoe has been worn down to the point where crucial support (arch support, for example) has eroded thereby increasing the likelihood of injury. In this way, by providing a notification that one or both of the running shoes should be replaced, the runner may be better able to avoid injuries related to outworn equipment.

A sensor can also include location-sensing devices (such as a GPS receiver) that provide velocity and/or location data to a processor unit that can be coupled to a database having information such as physical characteristic data such as weight, age, and gender. The database can, in turn, provide an updated readout to a display unit of the user's ongoing athletic performance statistics. Such statistics can include elevation gain, speed, heading, elevation, calories burned, anticipated calories burned (based upon a pre-selected course), and others. Furthermore, the sensor can be coupled to a distributed network of computers, such as the Internet, by way of a wireless device or directly by way of an I/O port coupled to external circuitry, such as a personal computer, personal digital assistant (PDA), modem, etc., or in some cases as part of a peer-to-peer type arrangement of like wireless sensors or other wireless devices. In this way, the user can download selected data (such as other athlete's performance data, selected courses, training programs, etc.) allowing the user to be part of a virtual community of athletes that can interact with each other in real time or virtually. In some embodiments, the sensor can optionally include one or more dead reckoning devices to provide direction information or change of location information. Such dead reckoning devices can include altimeters, accelerometers, cadence measurements sensors and the like.

FIG. 1 illustrates an example of sensor 100 in accordance with an embodiment of the invention. Sensor 100 can include processor 102 that can be used to control the overall operation of sensor 100. Data can be stored in RAM 104 that can provide volatile data storage and Read-Only Memory (ROM) 106 for storing programs, utilities or other processes to be executed. Sensor 100 can also include user input device 108 that allows a user to interact with sensor 100. For example, user input device 108 can take a variety of forms, such as a button, keypad, dial, etc. having associated labels to enable a user to know how to request an operation of sensor 100. In one embodiment, the labels are hard or permanent. Alternatively, the labels are soft or can be changed by the user according to a menu of operations. Data bus 110 can facilitate data transfer between at least ROM 106, RAM 104, processor 102 and one or more output devices 112 used to communicate with external circuitry. Such output devices 112 can include I/O data port 114 or wireless interface 116. More generally, they can include an audio and/or visual indicator 118 such as speakers and/or LEDs that can be used to notify a user of an event. Output devices 112 can be in communication with processor 102 directly (or by way of data bus 110). In the case of wireless interface 116, a wireless communication channel can be opened that can be used for transmitting and receiving data between sensor 100 and external circuitry using, for example, RF carrier waves, infrared (IR) signals, etc.

If GPS capable, sensor 100 can utilize line of sight to GPS antenna 120 to receive GPS satellite signals at GPS receiver 122 from one or more GPS satellites to determine a location of sensor 100 and/or a time of observation. In some embodiments, sensor 100 can include one or more dead reckoning devices 124 to provide direction information or change of location information. Such dead reckoning devices include altimeters, accelerometers, cadence measurement sensors and the like. For example, cadence measurement sensors utilize the rhythmic motion associated with the athletic performance (e.g., the user's strides) to extrapolate the user's speed and distance during periods of satellite blockage thereby further enhancing the robustness of the system in challenging environments with high levels of signal blockage. Authorization module 128 can be used to facilitate the electronic pairing of a garment and sensor 100 by processing garment identification credentials.

In those embodiments of sensor 100 that include GPS receiver 122, RAM 104 can store in addition to selected data such as measured user performance metrics, local elevation data in digital elevation model (DEM) database 126 in the form of DEM data. In addition to local elevation data, DEM database 126 can store local points of interest (such as restaurants, rest stops, parks, shops, etc.) that can be updated by the user or downloaded from external circuitry. DEM data can serve to improve the accuracy of the GPS elevation and speed measurements as well as to improve the tolerance of sensor 100 to satellite blockage. Processor 102 can be configured to calculate carrier-wave Doppler-shift based user velocity based upon data received from GPS receiver 122 and DEM database 126 and calculate selected athletic performance feedback data using the calculated user velocity and other data such as the elevation profile and the user physical characteristics. The use of Doppler based velocity measurements gives accuracies in the range of 0.1 mph in typical GPS receivers, which is the highest accuracy typically required for useful assessment of athletic activities.

Sensor 100 can be coupled to a distributed network of computers, such as the Internet, or other like sensors in a peer-to-peer arrangement by way of wireless interface 116 and/or I/O port 114 coupled to external circuitry, such as a personal computer, personal digital assistant (PDA), modem, and the like. In this way, a user can download selected data related to, for example, other athlete's performance data, selected courses, training programs, and so on. The user can also be part of a virtual community of athletes each of whom can interact with each other as well as provide for favorite-routes databases, regimen databases, performance benchmarking, and route mapping and planning, and so on.

Figure 2A:
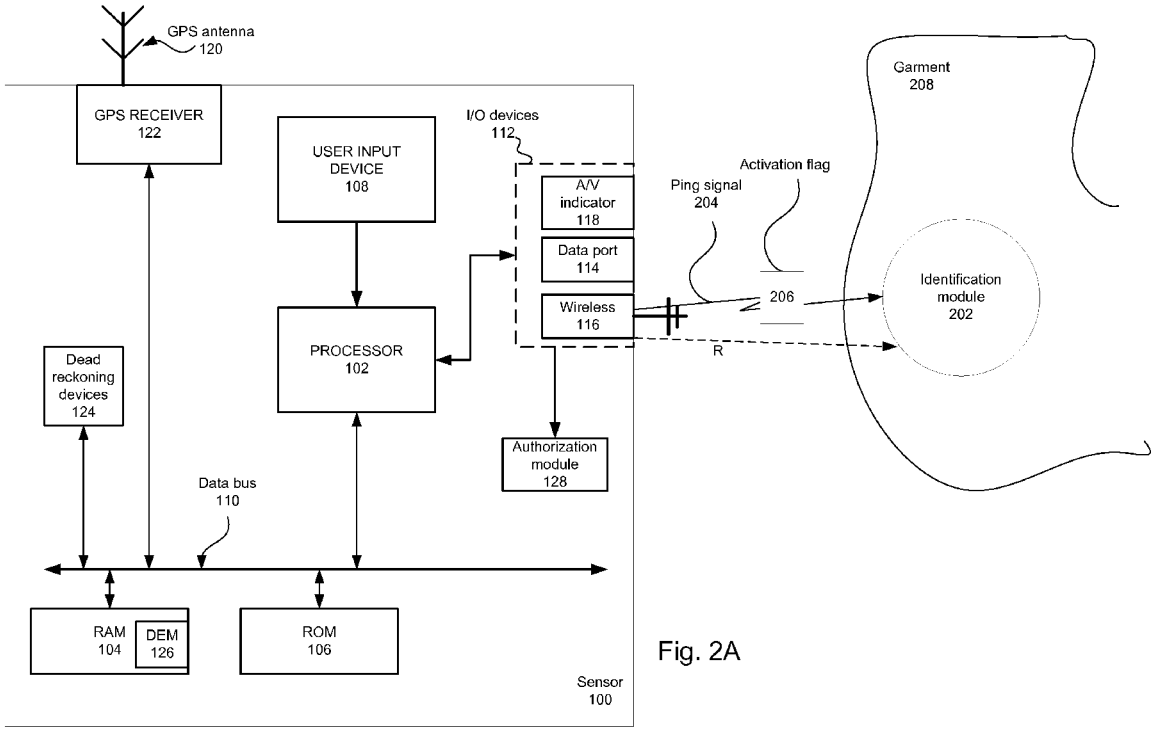
FIGS. 2A and 2B illustrate authenticating sensor and garment in accordance with an embodiment of the invention.

As shown in FIG. 2A, wireless sensor 100 can periodically emit ping signal 204 that can include activation flag 206. In some embodiments, activation flag 206 can activate (i.e., wake up) identification module 202 only when signal strength $S_r$ associated with ping signal 204 is greater than a preset threshold value $S_{th}$. In this way, only those sensors within range R appropriately programmed can be activated, thereby preventing sensors other than those intended for placement on or near the tagged garment from communicating with identification module 202. It should be noted that the actual activation process is not strictly limited to wireless technology. For example, various other activation technologies include, but are not limited to, magnetic activation (such as the Hall effect), resistor/capacitor activation/authorization. In addition to activation techniques discussed, sensor 100 can be automatically deactivated or placed into a hold state when sensor 100 is removed from garment 208 and/or when sensor 100 is moved beyond range R.

Identification module 202 can be attached to or otherwise associated with garment 208 by being sewn onto garment 208, secured to garment 208 by way of fasteners, woven into the fabric of garment 208, and so on. Since it is identification module 202 itself that provides the identification information used to electronically pair sensor 100 and garment 208, it is important that identification module 202 be securely connected to garment 208 such that it does not fall off or otherwise become detached during use (that can result in a warning from the sensor that the authentication has lapsed thereby helping to reduce the incidence of lost or stolen sensors). It should be noted that the identification module 202 could be dedicated to garment 208 (at the time of manufacture of the garment, for example) providing in addition to identification information other useful information (such as date of manufacture, time of use since date of manufacture, and so on) associated with a particular garment. In this way, identification module 202 can provide data storage functions such as backing up selected data, providing a database of information that is matched to garment 208 independent of any particular sensor and so on. This arrangement can be especially helpful in situations where a sensor has been lost or otherwise compromised to the degree where the chances of retrieving any data stored in the sensor would be very remote.

Identification module 202 can be fabricated using radio frequency identification (RFID) technology that can store and remotely retrieve data using devices called RFID tags or transponders. An RFID tag is an object that can be attached to or incorporated into a product, animal, or person for the purpose of identification using radio waves (chip-based RFID tags can contain silicon chips and antennas). Passive tags require no internal power source since they rely upon electrical current induced in the antenna by the incoming radio frequency signal to power up and transmit a response. It should be noted that the response of a passive RFID tag is not necessarily just an ID number, the passive RFID tag can contain non-volatile memory device (such as EEPROM) for storing data. Unlike passive RFID tags, active RFID tags have their own internal power source that is used to power any ICs that generate the outgoing signal. Active tags are typically much more reliable (e.g., fewer errors) than passive tags due to the ability for active tags to conduct a "session" with a reader. Active tags, due to their onboard power supply, also transmit at higher power levels than passive tags, allowing them to be more effective in "RF challenged" environments like water, metal, or at longer distances. A number of non-invasive and reliable power sources such as batteries and in some cases, piezoelectric or kinetic power sources activated by the use of the garment can be used to supply the requisite power for the active RFID tags.

Figure 2B:
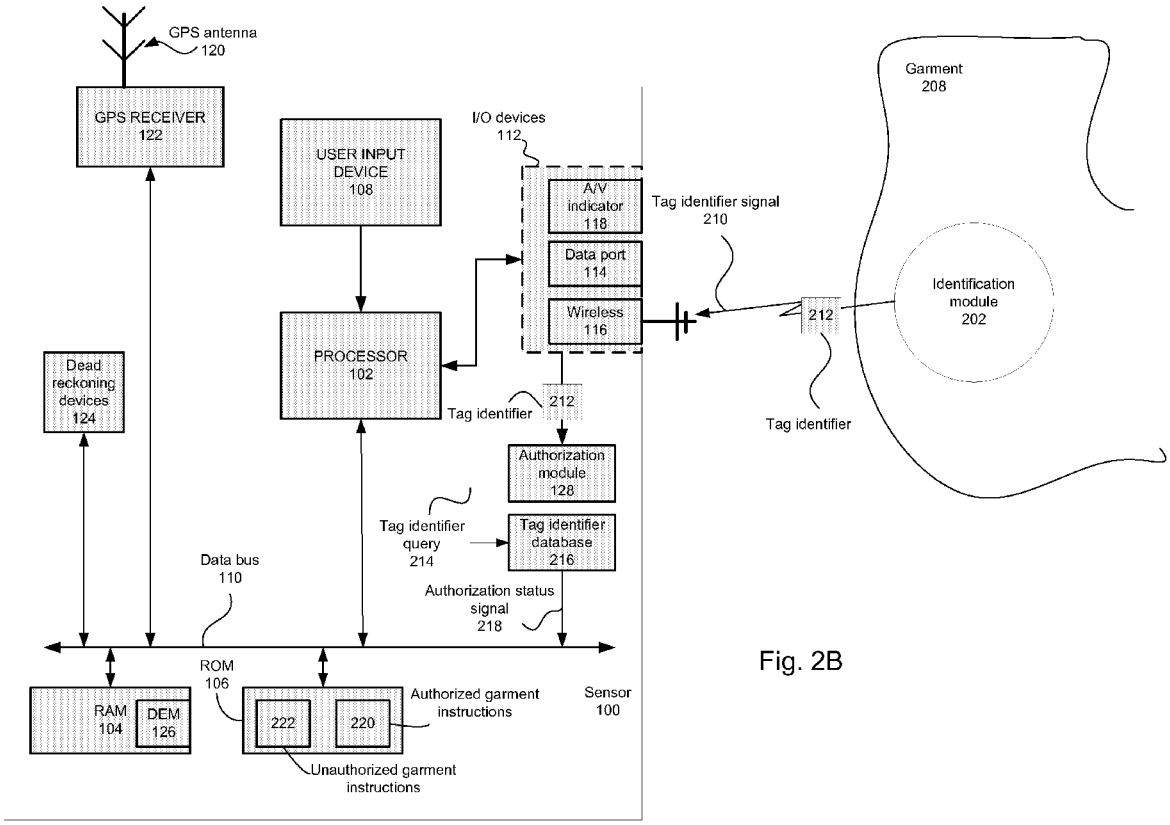

With reference to FIG. 2B, identification module 202 can generate tag identifier signal 210 that can include tag identifier 212 that can include a number of garment identification indicia (e.g., numerical, alphanumeric). Some or all of the garment identification indicia can be encrypted providing additional security. Sensor 100 can wirelessly transmit tag identifier signal 210 (or any appropriate portion thereof) at wireless interface 116 that can be received at authorization module 128. Authorization module 128 can then forward tag identifier query 214 to tag identifier database 216. In the described embodiment, tag identifier database 216 can include a list authorized tag identifiers used to determine an authorization status of tag identifier 212 by, for example, comparing tag identifier 212 to the list of authorized tag identifiers stored in tag identifier database 216. Authorization status signal 218 can be generated indicating whether or not tag identifier 212 matches an authorized tag identifier stored in tag identifier database 216. Authorization status signal 218 can be forwarded to processor 102 that can, in turn, execute instructions based upon authorization status signal 218. For example, if authorization status signal 218 indicates that tag identifier 212 matches an entry in the list of authorized tag identifiers, then processor 102 can be directed to execute authorized garment instruction set 220. However, if authorization status signal 218 indicates tag identifier 212 does not match an entry in the list of authorized tag identifiers (i.e., no match), processor 102 can be directed to execute unauthorized garment instruction set 222 indicating that the garment identification information does not correspond to an authorized garment.

For example, when processor 102 executes unauthorized garment instruction set 222, sensor 100 can be instructed by processor 102 to perform a number of predetermined actions consistent with an unauthorized garment. Such pre-determined actions can include, for example, issuing an alert by way of audio/visual output device 118 (beep from a speaker, flashing LED, etc.) that notifies the user that the garment (or more accurately, the identification module associated with the garment) is not authorized to be used with sensor 100 and to display actions that can be taken by the user to rectify the condition. Such actions can include instructing the user to register the tag identifier associated with the unauthorized garment or instructing sensor 100 to shut down in order to prevent what appears to be an attempt to pair sensor 100 with an unauthorized garment. In this case, sensor 100 can then be restarted by a user entering an authorization code by way of user input device 108, for example, thereby preventing unauthorized pairing of sensor 100 with garment 208.

When processor 102 executes authorized garment instruction set 220, sensor 100 can be instructed by processor 102 to perform a number of predetermined actions consistent with an authorized garment. Such predetermined actions can include accessing tag identifier database 216 in preparation for a forthcoming activity for which sensor 100 would generate performance data of either (or both) garment 208 and/or the user. In the described embodiment, tag identifier database 216 can include information for all registered identification modules and associated garments an example of which is shown in FIG. 3.

Figure 3:
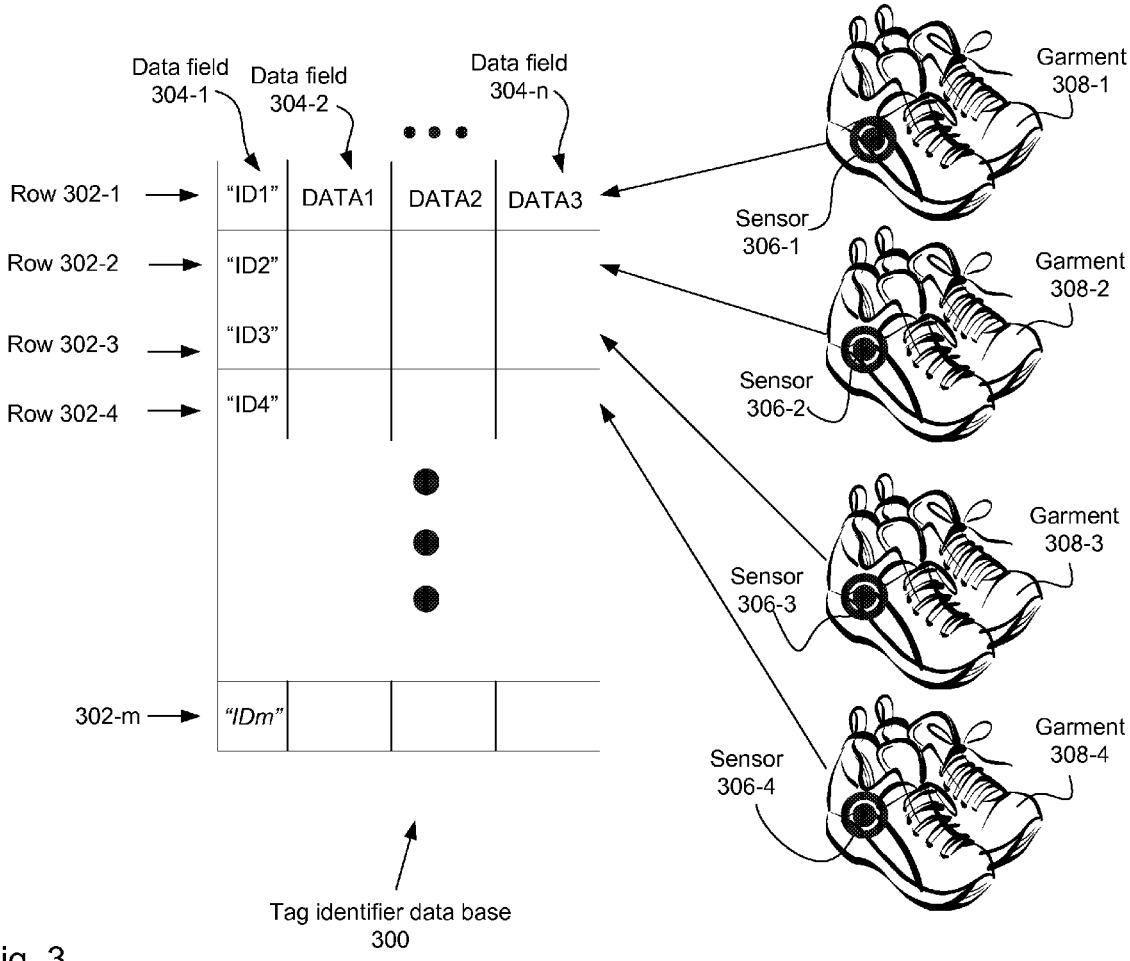
FIG. 3 shows representative tag identifier database in accordance with an embodiment of the invention.

FIG. 3 shows representative tag identifier database 300 in accordance with an embodiment of the invention. It should be noted that tag identifier database 300 is a particular implementation of tag identifier database 216 described above and is therefore only exemplary in nature. Tag identifier database 300 can be constructed along the lines of a m×n memory array having m rows (302-1 through **302-*m*), each corresponding to a particular tag identifier (that, in turn, can be associated with a particular garment) and n columns each being of suitable size for storing data related to a particular garment in a data field of appropriate length. For example, row 302-1 includes data fields 304-1 through 304-*n* where data field 304-1 is used to store tag identifier "ID1" corresponding to tag identifier stored in sensor 306-1 attached to garment (in this case a running shoe) 308-1. Remaining data fields 304-2 through 304-*n* can be used to store any data deemed appropriate such as performance data, garment wear data, purchase date, and so on that can be used in subsequent analysis. It should be noted that at any time, any of sensors 306 can be swapped for any other sensor or interchanged between any of garments 308** thereby affording the user complete freedom of association between available sensors, garment inventory, or sensor/garment replacements.

In this way, an extensive database of pertinent garment data can be stored and made available for the user and any other interested party such as a manufacturer interested in garment wear patterns, a user interested in correlating specific garment design to user performance statistics as would be the case with running shoes and run times, for example. Such data can include specific performance data (number of hours of use from time of purchase, for example) and any other data deemed appropriate. It should be noted that there could be a one-to-one correspondence between a particular garment and a particular tag identifier at a time. However, at any time, a particular tag identifier can be re-assigned to any other garment simply by removing the identification module associated with the particular tag identifier from one garment and placing it onto or in another garment. Moreover, the tag identifier can itself be re-assigned by, for example, re-programming a non-volatile type memory device (incorporated in the identification module) into which the particular tag identifier had been previously programmed.

Figure 4:
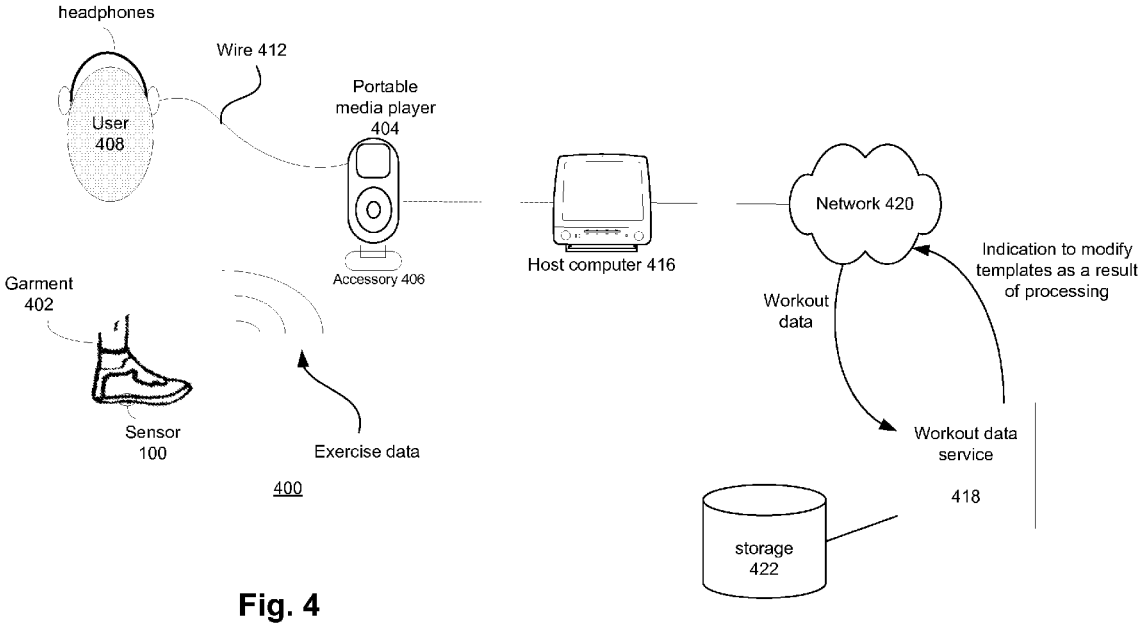
FIGS. 4-5 illustrates system for monitoring and/or controlling user exercise or other activity or physiology in accordance with an embodiment of the invention.

FIG. 4 illustrates system 400 for monitoring and/or controlling user exercise or other activity or physiology in accordance with an embodiment of the invention. System 400 can include sensor 100 coupled to garment 402 (which in this case takes the form of an athletic shoe) in communication with processing device 404 that can take the form of portable media player 404. User exercise data can be communicated (in this example, wirelessly) from sensor 100 configured for gathering physiological data of a user (such as a sensor to sense the foot motion of a user) to portable media player 404. In one example, the user exercise data is wirelessly transmitted via accessory 406 which can be configured to selectively attach to a data port of portable media player 404. An example of accessory 406, and the interoperation of the accessory with portable media player 404, is described in U.S. patent application Ser. No. 11/439,521 filed May 22, 2006, and entitled "COMMUNICATION PROTOCOL FOR USE WITH PORTABLE ELECTRONIC DEVICES" incorporated by reference herein.

User physiological data can be accumulated by sensor 100 and then provided wirelessly to portable media player 404. Meanwhile, cues relative to the exercise (e.g., audio cues) provided by, for example, exercise templates retrieved from portable media player 404 to the user (by way of, for example, wire 412 and headphones 414). In addition to providing the cues relative to the exercise, portable media player 404 can also be configured to provide playback of media (such as audio media) to user 408 (also via wire 412 and headphones 414 or any other appropriate communication channel) that could, for example, be coordinated with the exercise cues. For example, playback of media can be accomplished by playing back music from a play list created using iTunes® software application provided by Apple Computer, Inc., running on host computer 416 and then downloaded to portable media player 404 for subsequent playback. In this way, play lists (and any other suitable media) can be associated with exercise templates.

Portable media player 404 can also be configured to provide physiologic data to workout data service 418 via host computer 416 that can be configured to operate in any number of modes. For example, host computer 416 can operate as a conduit for providing the physiologic data to workout data service 418. Alternatively, host computer 416 can process the physiologic data and/or temporarily store the physiologic data for later forwarding such as, for example, during a temporary loss of connection between host computer 416 and service 418 via network 420. Furthermore, physiologic data can be processed at workout data service 418 in any number of ways. For example, physiologic data from one user can be processed in view of physiologic data from other users in order to compare the users in terms of performance. In another example, the physiologic data can be processed by workout data service 418 to determine a suggested template change such as changing the clues to provide motivation at a particular portion of the workout. As another example, based on play lists associated with that workout by other users, a different play list (or changes to the play list) can be suggested for a particular workout.

Figure 5:
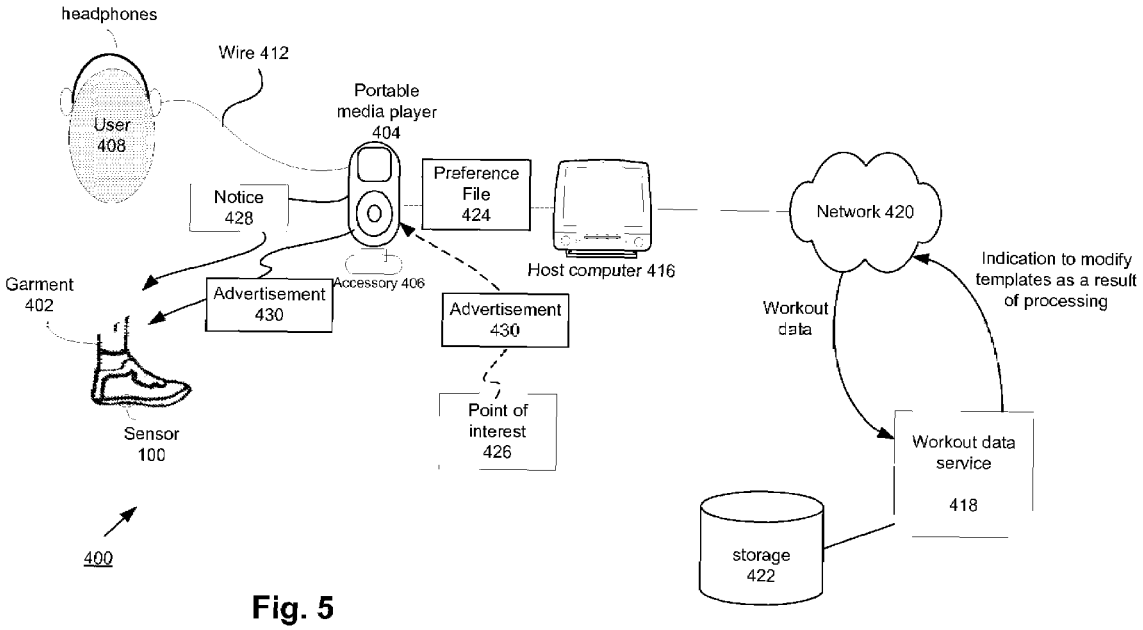

In addition to providing physiologic data, sensor 100 can provide indications of nearby locations of interest as shown in FIG. 5. For example, when sensor 100 incorporates real time location technology (such as GPS), sensor 100 can periodically check for nearby points of interest (included in a DEM database in the case of a GPS enabled system) provided, in some cases, by the user and in other cases by a workout template specific for the area in which the user plans to exercise. For example, in a GPS based system, prior to a workout (or other anticipated excursion such as a hike or bike ride), the user can download a list of preferred establishments (restrooms, restaurants, etc.) to the DEM database 126 specific for the area in which the user plans to exercise (local parks, bike routes, jogging trails, etc). The downloading can be accomplished by, for example, accessing an external device (such as host computer 416 or media player unit 404) in which is stored preference file 424 that includes indicators of points of interest for the designated area. When the user approaches one of the points of interest (restaurant 426, for example) while exercising, sensor 100 can issue notification 428 that the user is within a pre-determined distance of the nearby point of interest thereby providing the user the option to stop or continue the planned excursion unabated. Moreover, the nearby point of interest (i.e., restaurant 426) can also push information 430 to the user by, for example, displaying advertisements in addition to the notification that the user is within the pre-determined distance.

Figure 6:
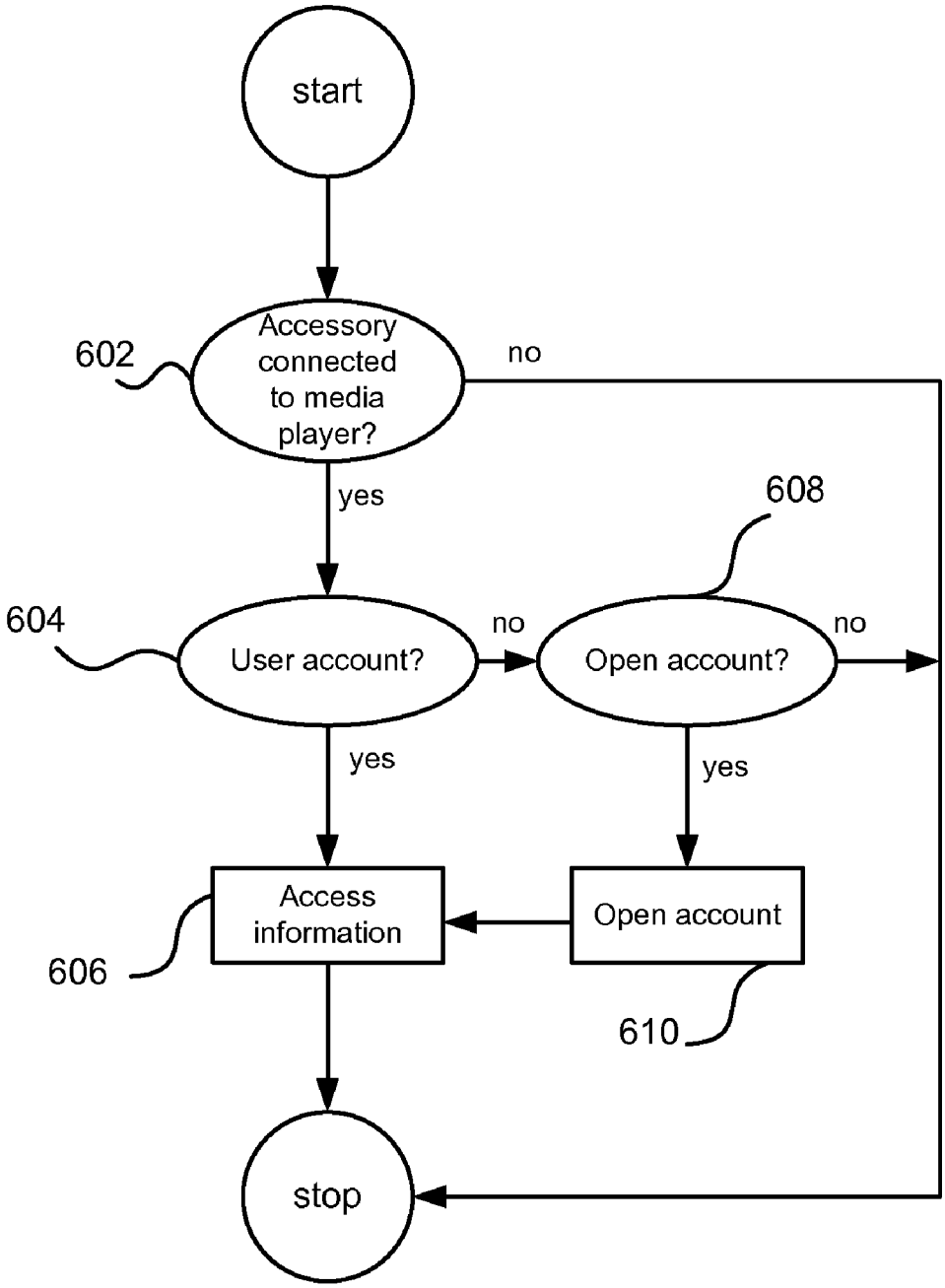
FIG. 6 is a flowchart illustrating an example of steps, mostly within the host computer to accomplish transfer of physiologic data between the portable media player and workout data service in accordance with an embodiment of the invention.

FIG. 6 is a flowchart illustrating a process 600 to accomplish transfer of physiologic data between portable media player 404 and workout data service 418. At 602, a determination is made if accessory 406 is connected to portable media player 404 (which, if connected, would allow physiological data to be received by portable media player 404 from sensor 100). This determination can be accomplished by, for example, using configuration data provided to host computer 416 when portable media player 404 and host computer 416 are connected using a handshake protocol. The configuration data can include such information as device characteristics, capabilities and/or activities of portable media player 404 and so on. If it is determined at 602 that accessory 406 is not connected to portable media player 404, then process 600 ends, otherwise, at 604, a determination is made if the user has an account at workout data service 418. If it is determined that the user does have an account, then processing continues to 606, otherwise, the user is requested to open an account at 608 before going any further. If the user does not desire to open an account, then process 600 ends, otherwise, an account is opened at 610. Once an account is opened, at 606, computer 416 accesses the physiologic data, if any, stored in portable media player 404 and provides the physiologic data to workout data service 418 to be associated with the user's account. In some cases, some or all of the provided physiologic data can be retained on portable media player 404 for easy reference by the user (such as during or in preparation for a workout). For example, a portion of the physiologic data corresponding to the last few workouts can be retained in storage of portable media player 404 that can then be displayed by way of a display screen of the portable media player 404.

Figure 7:
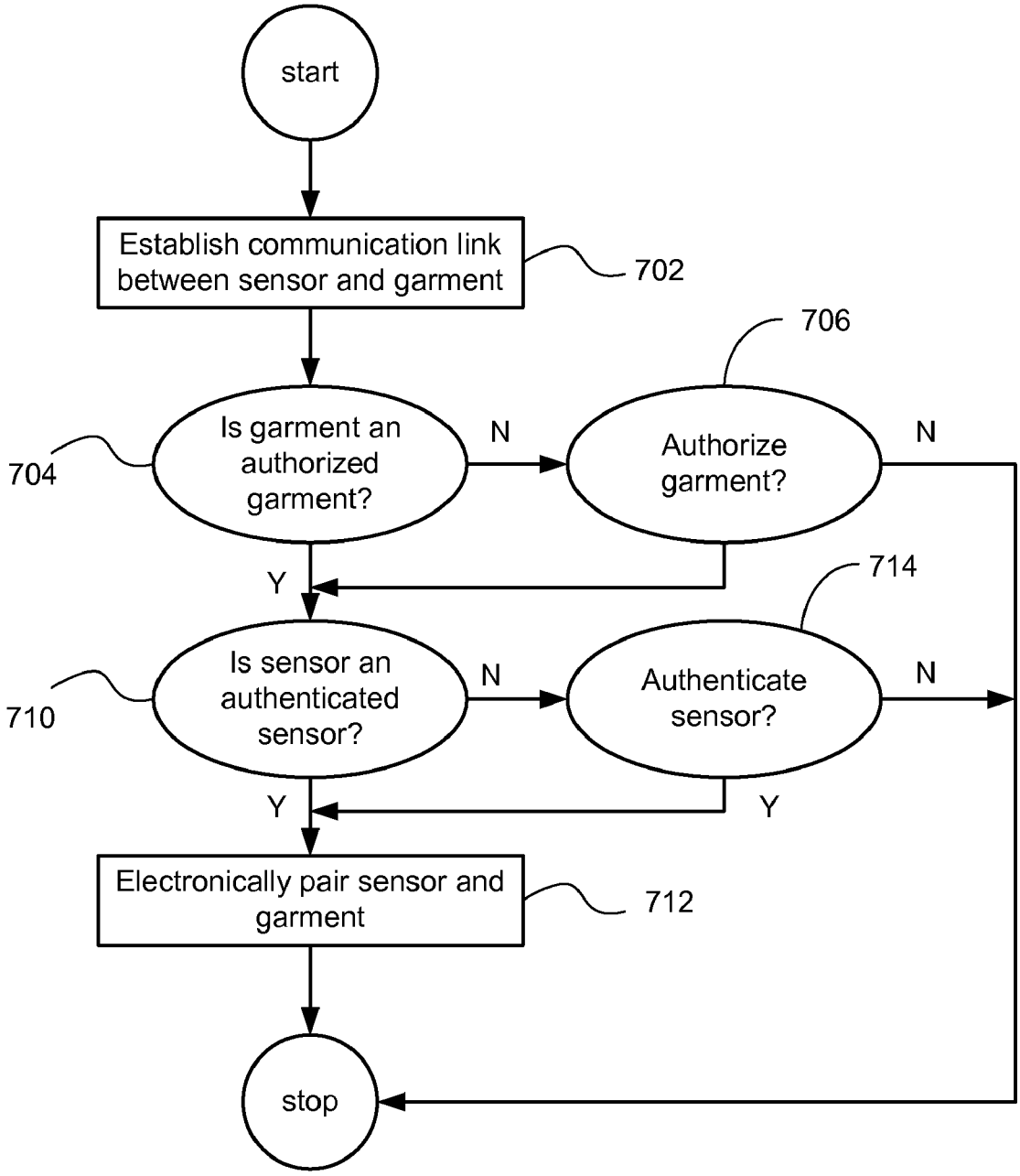
FIG. 7 shows a flowchart detailing a process for electronically pairing a sensor and a garment in accordance with an embodiment of the invention.

FIG. 7 shows a flowchart detailing a process 700 for electronically pairing a sensor and a garment in accordance with an embodiment of the invention. Process 700 begins at 702 by establishing a communication link between the garment and the sensor. The communication link can be a wireless communication link (RF, audio, etc.) or carried over a signal wire. In any case, once the communication link has been established, a determination is made at 704 if the garment is an authorized garment. By authorized it is meant that the garment has been identified for use with the sensor. For example, a clothing manufacturer may only want certain of its product line to belong to the class of garments that can electronically pair with a particular sensor. This may be due to any number of reasons, such as the garment must be specifically fabricated to be able to work with the sensor and therefore, not every garment would be suitable, or the manufacturer may only want those garments in a certain price range to be paired with the sensor.

If the garment is not authorized, then in one embodiment, an option can be provided at 706 for authorizing the garment by, for example, updating a list of authorized garment information to include the garment information of the unauthorized garment. This is particularly useful in those situations where, for example, a manufacturer wishes to update a product line that was heretofore has not been authorized to be used with the sensor. On the other hand, if the garment is authorized, then at 710 a determination is made if the sensor is an authenticated sensor. By authenticated it is meant that the sensor has been certified for use with the garment (or class of garments) that have been designed for use with the sensor. By assuring that only authenticated sensors are electronically paired with the garment, the likelihood that a stolen, lost, or otherwise compromised sensor can be used is substantially reduced. If the sensor is determined to be authenticated, then the sensor and garment are electronically paired at 712 thereby allowing sensing data associated with the paired garment to be transmitted by the sensor to external circuitry, such as a portable computing device. In some embodiments, if the sensor not authenticated, than an option to authenticate the sensor can be provided at 714. This is useful in situations where, for example, a previously lost sensor (and therefore rendered unauthenticated) has been found.

Figure 8:
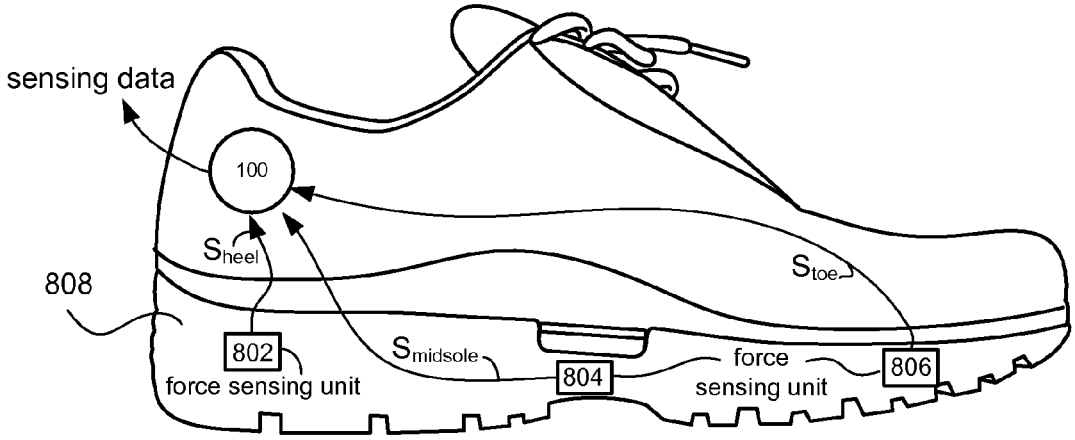
FIG. 8 shows a running shoe that has been electronically paired with a sensor in accordance with an embodiment of the invention.

Sensor 100 can provide performance data that can be user to improve garment performance and/or user performance. FIG. 8 shows running shoe 800 that has been electronically paired with sensor 100 in accordance with an embodiment of the invention. Shoe 800 includes applied force sensing units

Figure 9:
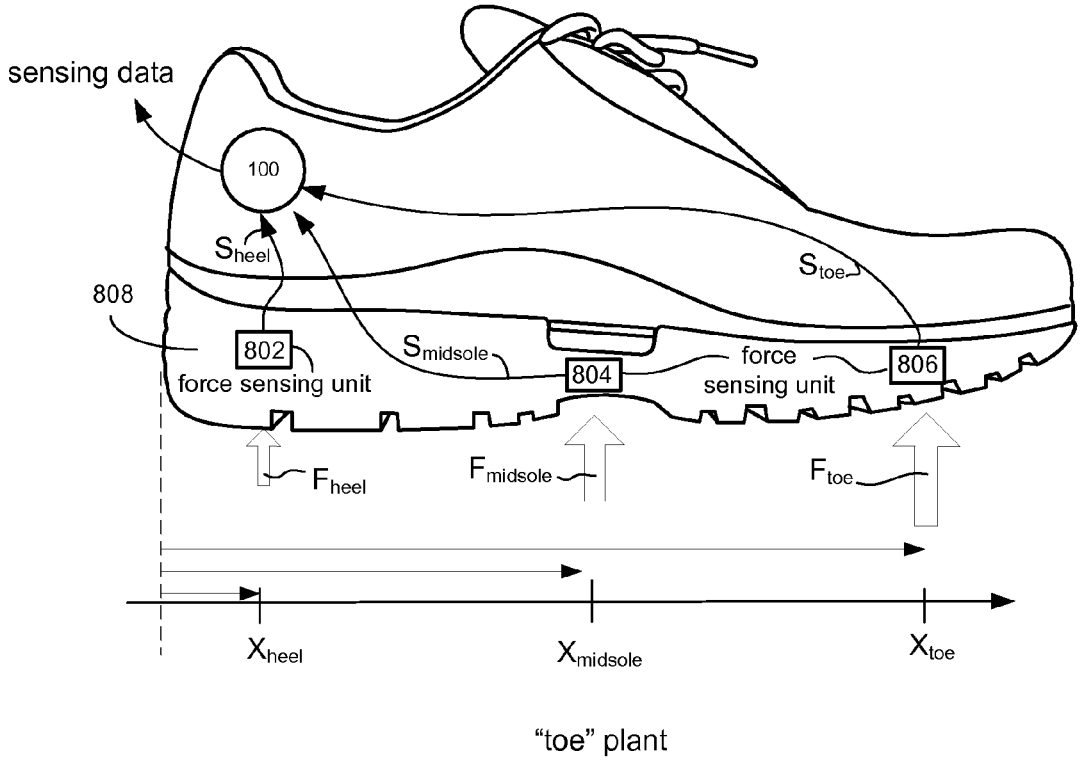
FIGS. 9-10 shows the running shoe of FIG. 7 being used in a toe plant type stride.
Figure 10:
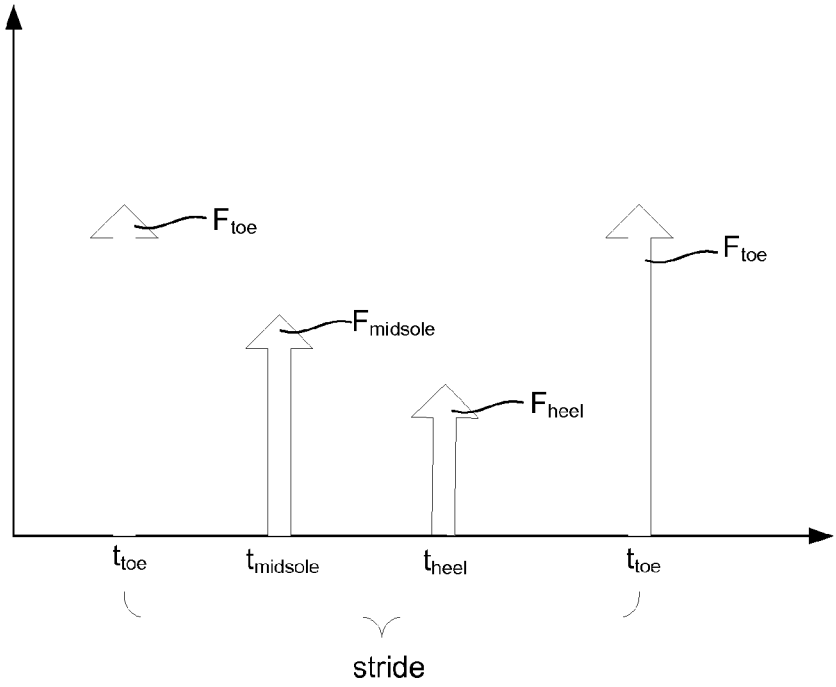
Figure 11:
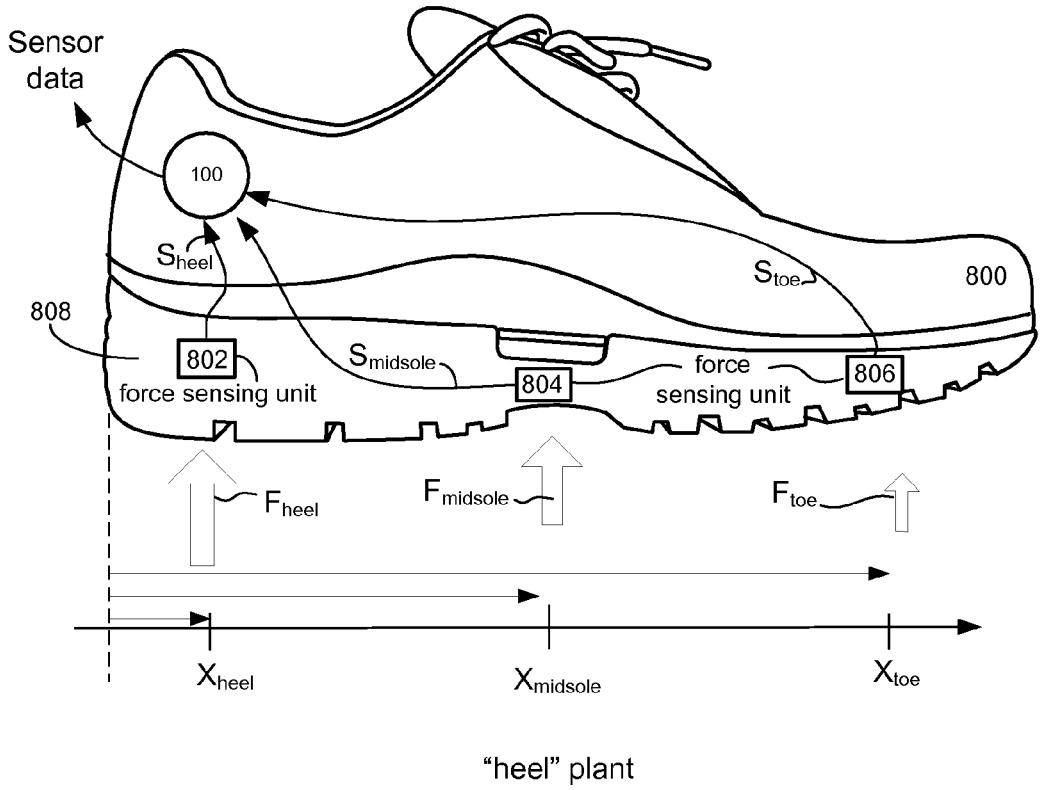
FIGS. 11-12 shows the running shoe of FIG. 7 being used in a heel plant type stride.
Figure 12:
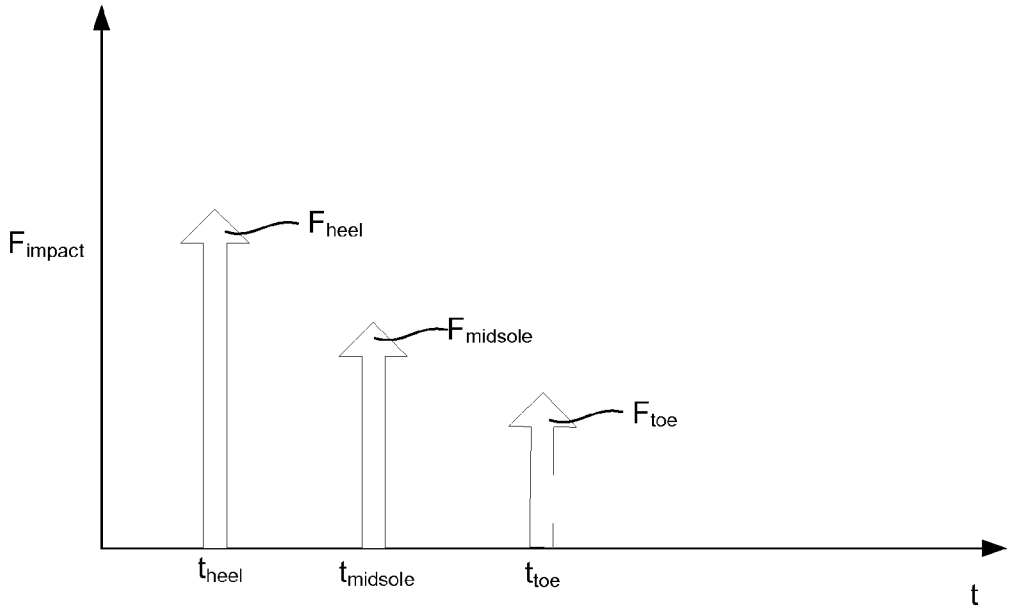

802, 804, and 806 placed in shoe sole 808 at heel location $X_{heel}$, midsole location $X_{midsole}$ and toe location $X_{toe}$ each arranged to respectively sense impact force $F_{heel}$, $F_{midsole}$, and $F_{toe}$. Sensors 802-806 each periodically send impact force sensing data $S_{heel}$, $S_{midsole}$, and $S_{toe}$ to sensor 100 most of which is then forwarded to an external computing device, such as portable media player 404 for processing. Such processing can include characterizing a user's running style in real time. For example, by comparing the relative forces of impact ($F_{toe}$ vs. $F_{midsole}$ vs. $F_{heel}$) and the temporal relationship between the occurrence of the forces of impact $F_{toe}$, $F_{midsole}$, and $F_{heel}$ ($t_{toe}$, $t_{midsole}$, $t_{heel}$), a user's stride can be characterized as either a toe plant type stride (see FIGS. 9 and 10) or a heel plant type stride (see FIGS. 11 and 12) where a user's stride can be defined as an amount of time between consecutive toe, heel, or mid-sole impacts for a particular shoe. Taken over a number of strides, a user's running style profile can be developed that provides a characterization of the user's overall running style.

Since, a runner's stride and stride type can vary over the course of a run (a sprint typically uses more of a toe plant style whereas a power walker would use more of a heel plant style), a user's running style profile can also vary over the course of the run (as well as well as over the course or months or years, or as the running shoes wear, or between different, but authorized, running shoes). Therefore, in order to more accurately gauge a user's overall running style, a user's average running style can be calculated. In some cases, the user's average running style is accumulated from a number of previous runs using the same running shoe or can incorporate average running styles from different (but authorized) running shoes, if desired. In this way, a user has the ability to compare running styles and/or performance not only from one run to another, but from one running shoe to another, or merely deduce an overall running style regardless of the running shoe used.

Figure 13:
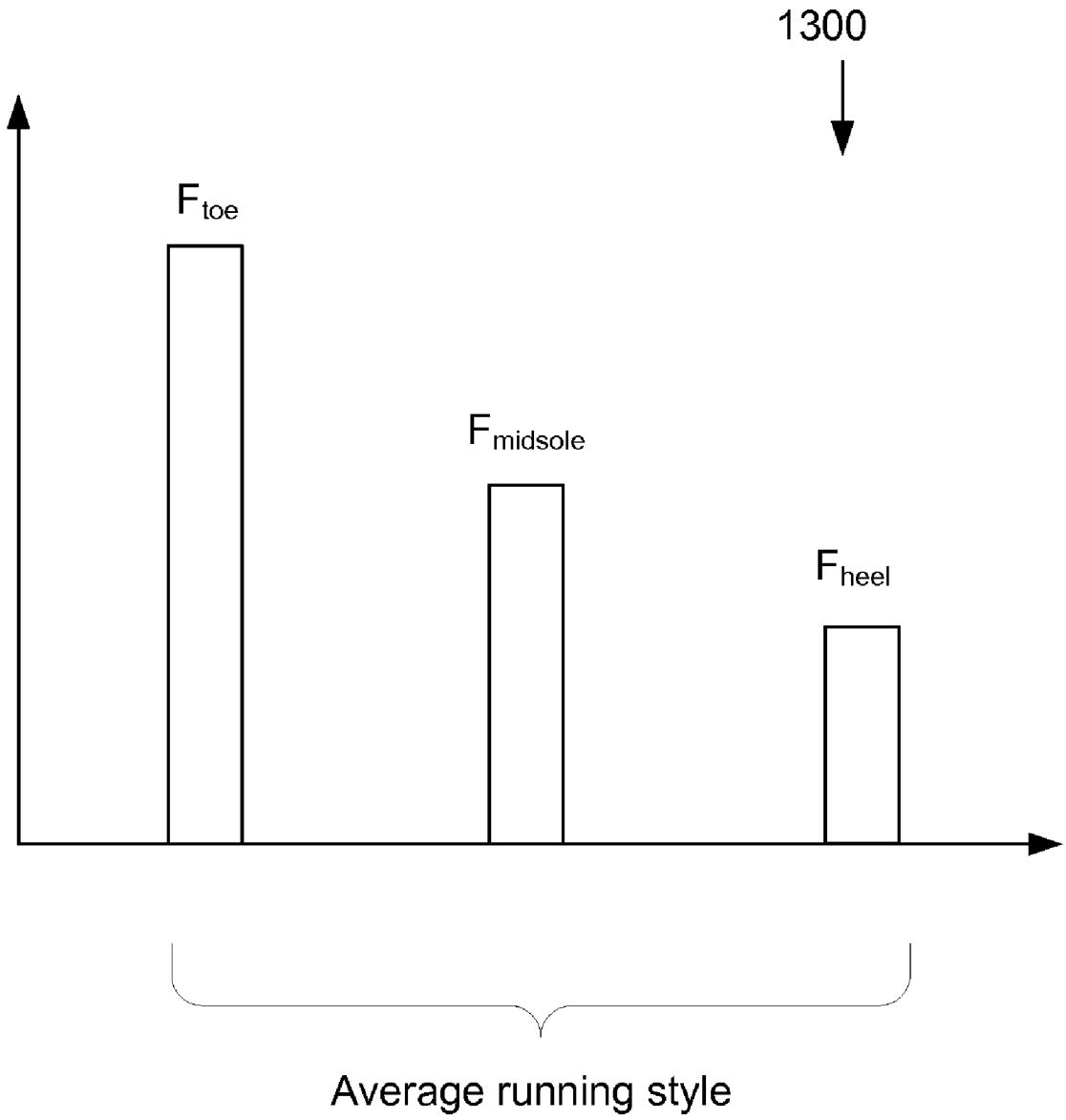
FIG. 13 shows a representative running style profile template in accordance with an embodiment of the invention.

A virtual coach can provide real time feedback to a user either during or after a run by comparing a user's running style profile to a running style profile template 1300 as illustrated in FIG. 13. Running style template 1300 incorporates what could be considered an optimal running style profile for a particular user based upon age, gender, distances run, frequency of running, type of running (hills, intervals, flats, etc.) each modified for the particular running shoes used. By periodically comparing a user's real time running style profile to the appropriate optimal running style template, media player 404, for example, can provide real time coaching suggestions (i.e., "increase stride", "decrease stride", "increase toe plant", "increase heel plant", and so on) to the user during the run, for example, or after a run by providing a summation of user's running style and suggestions for how to modify it.

While this invention has been described in terms of a preferred embodiment, there are alterations, permutations, and equivalents that fall within the scope of this invention. It should also be noted that there are many alternative ways of implementing both the process and apparatus of the present invention. It is therefore intended that the invention be interpreted as including all such alterations, permutations, and equivalents as fall within the true spirit and scope of the present invention.

What is claimed is:

1. A method of electronically pairing a sensor and a garment, comprising:

establishing a bi-directional communication link between the sensor and the garment;

accessing processing resources incorporated in the garment, the processing resources being independent of the sensor and used to determine if the garment is authorized, the processing resources including memory resources, the memory resources storing information including garment identification data, backup garment performance data and back up user performance data;

using the garment identification data to determine if the garment is an authorized garment; and electronically pairing the garment and the sensor only if the garment is authorized and the sensor is authenticated, wherein if the garment is determined to be not authorized and the sensor is determined to be authenticated, then, authorizing the garment by a garment user inputting an appropriate authorization code to the sensor.

2. A method as recited in claim 1, further comprising:

receiving the garment performance data and the garment user performance data when the garment and the sensor are electronically paired with each other; and using the memory resources in the garment to back up the garment performance data and the garment user performance data.

3. A method as recited in claim 1, wherein the determining if the garment is the authorized garment comprises:

receiving the garment identification information by the sensor; and comparing the garment identification information to authorized garment identification information stored in the sensor.

4. A method as recited in claim 1, further comprising:

receiving the garment data by the sensor; and passing the garment data to an external circuit for further processing.

5. A method as recited in claim 4, wherein the garment data includes a garment manufacture date, garment wear data, a garment wear threshold value.

6. A method as recited in claim 5 comprising:

comparing a current garment wear data value to the garment wear threshold value; and issuing a wear notification based upon the comparison of the current garment wear data value and the garment wear threshold value.

7. A method as recited in claim 1, further comprising:

receiving user performance data by the sensor; and passing the user performance to an external circuit for further processing.

8. A method as recited in claim 7, wherein when the garment is a shoe, then the user performance data includes stride data, force of impact data and corresponding location of impact data.

9. A method as recited in claim 8, further comprising:

calculating a user running style profile based upon the stride data, the force of impact data and the corresponding point of impact data;

comparing the user running style profile to a running style profile template; and issuing virtual coaching instructions based upon the comparison of the user running style profile and the running style profile template.

10. A method as recited in claim 9, wherein the external circuit is a computing device arranged to process the received data.

11. A method as recited in claim 10, wherein the computing device is part of a network of computing devices.

12. A method as recited in claim 11, wherein the data is processed by at least one of the network of computing devices.

13. A method as recited in claim 12, wherein at least one of the computing devices is a personal portable computing device.

14. A computer readable storage medium embodied in a tangible form and including at least computer program code for electronically pairing a sensor and a garment, the computer readable storage medium comprising:

computer code for establishing a bi-directional communication link between the sensor and the garment;

computer code for accessing processing resources incorporated in the garment, the processing resources being independent of the sensor and used to determine if the garment is authorized, the processing resources including memory resources, the memory resources storing information including garment identification data, backup garment performance data and back up user performance data;

computer code for using the garment identification data to determine if the garment is an authorized garment; and computer code for electronically pairing the garment and the sensor only if the garment is authorized and the sensor is authenticated, wherein if the garment is determined to be not authorized and the sensor is determined to be authenticated, then, authorizing the garment by a garment user inputting an appropriate authorization code to the sensor.

15. The computer readable storage medium as recited in claim 14, further comprising:

computer code for receiving the garment performance data and the garment user performance data when the garment and the sensor are electronically paired with each other; and computer code for using the memory resources in the garment to back up the garment performance data and the garment user performance data.

16. The computer readable storage medium as recited in claim 15, wherein the computer code for determining if the garment is an authorized garment further comprises:

computer code for receiving the garment identification information by the sensor; and computer code for comparing the garment identification information to authorized garment identification information stored in the sensor.

17. The computer readable storage medium as recited in claim 15, further comprising:

computer code for receiving garment data by the sensor; and computer code for passing the garment data to an external circuit for further processing.

18. The computer readable storage medium as recited in claim 17, wherein the garment data includes a garment date of manufacture, garment wear data, a garment wear threshold value.

19. The computer readable storage medium as recited in claim 18 comprising:

computer code for comparing a current garment wear data value to the garment wear threshold value; and computer code for issuing a wear notification based upon the comparison of the current garment wear data value and the garment wear threshold value.

20. The computer readable storage medium as recited in claim 15, further comprising:

computer code for receiving user performance data by the sensor; and computer code for passing the user performance to an external circuit for further processing.

21. The computer readable storage medium as recited in claim 20, wherein when the garment is a shoe, then the user performance data includes stride data, force of impact data and corresponding location of impact data.

22. The computer readable storage medium as recited in claim 21, further comprising:

computer code for calculating a user running style profile based upon the stride data, the force of impact data and the corresponding point of impact data;

computer code for comparing the user running style profile to a running style profile template;

computer code for issuing virtual coaching instructions based upon the comparison of the user running style profile and the running style profile template.

23. The computer readable storage medium as recited in claim 22, wherein the external circuit is a computing device arranged to process the received data.

24. The computer readable storage medium as recited in claim 23, wherein the computing device is part of a network of computing devices.

25. The computer readable storage medium as recited in claim 24, wherein the data is processed by at least one of the network of computing devices.

26. The computer readable storage medium as recited in claim 25, wherein at least one of the computing devices is a personal portable computing device.

27. A system, comprising:

a sensor having a bi-directional communication interface; and a garment electronically paired with the sensor only if the garment is authorized and the sensor is authenticated, wherein the sensor determines if the garment is authorized by establishing a bi-directional communication channel with the garment, retrieving garment identification data from processing resources incorporated into the garment, using the bi-directional communication channel, and comparing the identification data to a database of authorized garment identifiers, wherein if the garment is determined to be not authorized and the sensor is determined to be authenticated, then the garment is authorized by a garment user inputting an appropriate authorization code directly to the sensor that updates the database of authorized garment identifiers, wherein when the garment and the sensor are electronically paired, the sensor receives data from the processing resources incorporated into the garment and passes the data to circuit external to the sensor and the garment for further processing.

28. A system as recited in claim 27, wherein the external circuit is a portable computing device in communication with the sensor.

29. A system as recited in claim 28, wherein the data received from the garment is user performance data.

30. A system as recited in claim 29, wherein when the garment is a shoe, then the user performance data includes stride data, force of impact data and corresponding location of impact data.

31. A system as recited in claim 30, wherein the further processing comprises:

calculating a user running style profile based upon the stride data, the force of impact data and the corresponding point of impact data;

comparing the user running style profile to a running style profile template;

issuing virtual coaching instructions based upon the comparison of the user running style profile and the running style profile template.

32. A system as recited in claim 31, wherein the portable computing device is part of a network of computing devices.

33. A system as recited in claim 32, wherein the user performance data is processed by at least one of the network of computing devices.

34. A system as recited in claim 33, wherein at least one of the computing devices is a portable multimedia player.

35. An sensor capable of being electronically paired with a garment, comprising:

a processor; and a bi-directional communication interface arranged to establish a bi-directional communication link between the sensor and the garment, wherein the processor electronically pairs the sensor with the garment by performing at least the following operations:

establishing a communication link between the sensor and the garment using the bi-directional communication interface;

accessing processing resources incorporated in the garment, the processing resources being independent of the sensor and used to determine if the garment is authorized, the processing resources including memory resources, the memory resources storing information including garment identification data, backup garment performance data and back up user performance data;

retrieving at least some of the garment information from the garment memory resources that includes the garment identification data;

using the garment identification data to determine if the garment is an authorized garment;

electronically pairing the garment and the sensor only if the garment is authorized and the sensor is authenticated, wherein if the garment is determined to be not authorized and the sensor is determined to be authenticated, then, authorizing the garment by a garment user inputting an appropriate authorization code to the sensor.

36. The sensor as recited in claim 35, wherein once the sensor and the garment are electronically paired, then the sensor receives garment data and user performance data.

37. The sensor as recited in claim 36, wherein the garment data and user performance data are passed by the sensor to an external circuit for further processing.

38. The sensor as recited in claim 37, wherein the external circuit is incorporated into a portable consumer electronic product.

39. The sensor as recited in claim 36, wherein the garment data includes a garment manufacture date, garment wear data, a garment wear threshold value.

40. The sensor as recited in claim 39 wherein the external circuit compares a current garment wear data value to the garment wear threshold value, and issues a wear notification based upon the comparison of the current garment wear data value and the garment wear threshold value.

41. The sensor as recited in claim 36, wherein when the garment is a shoe, then the user performance data includes stride data, force of impact data and corresponding location of impact data.

42. The sensor as recited in claim 41, wherein the external circuit further processes the user performance data by, calculating a user running style profile based upon the stride data, the force of impact data and the corresponding point of impact data;

comparing the user running style profile to a running style profile template; and issuing virtual coaching instructions based upon the comparison of the user running style profile and the running style profile template.

43. The sensor as recited in claim 35, wherein the processor determines if the garment is the authorized garment by comparing garment identification information received from the garment to authorized garment identification information.

* * * * *

UNITED STATES PATENT AND TRADEMARK OFFICE

CERTIFICATE OF CORRECTION

PATENT NO. : 7,698,101 B2
APPLICATION NO. : 11/683391
DATED : April 13, 2010
INVENTOR(S) : Brett G. Alten et al.

It is certified that error appears in the above-identified patent and that said Letters Patent is hereby corrected as shown below:

Title Page, item (56);

On Page 6, in column 1, under "Other Publications", line 20, delete "Augus" and insert -- Aug. --, therefor.

On Page 7, in column 1, under "Other Publications", line 10, delete "Conunents" and insert -- Comments --, therefor.

Signed and Sealed this
Fifteenth Day of November, 2011

David J. Kappos

David J. Kappos
*Director of the United States Patent and Trademark Office*